US008521046B2

(12) United States Patent
Sugiyama et al.

(10) Patent No.: US 8,521,046 B2
(45) Date of Patent: Aug. 27, 2013

(54) IMAGE FORMING APPARATUS

(75) Inventors: Keisuke Sugiyama, Tokyo (JP); Kouji Amanai, Kanagawa (JP); Joh Ebara, Kanagawa (JP); Toshiyuki Uchida, Kanagawa (JP); Yohei Miura, Tokyo (JP); Narumi Sugita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 281 days.

(21) Appl. No.: 12/962,078

(22) Filed: Dec. 7, 2010

(65) Prior Publication Data

US 2011/0222882 A1 Sep. 15, 2011

(30) Foreign Application Priority Data

Mar. 15, 2010 (JP) ..... 2010-058149

(51) Int. Cl.
*G03G 15/00* (2006.01)

(52) U.S. Cl.
USPC ..... 399/49

(58) Field of Classification Search
USPC ..... 399/49, 301
See application file for complete search history.

(56) References Cited

U.S. PATENT DOCUMENTS

| | | | |
|---|---|---|---|
| 7,050,738 | B2 | 5/2006 | Amanai |
| 7,206,537 | B2 | 4/2007 | Funamoto et al. |
| 7,352,978 | B2 | 4/2008 | Ebara et al. |
| 7,369,795 | B2 | 5/2008 | Funamoto et al. |
| 7,376,376 | B2 | 5/2008 | Ebara et al. |
| 7,532,842 | B2 | 5/2009 | Handa et al. |
| 7,603,061 | B2 | 10/2009 | Ebara et al. |
| 7,630,657 | B2 | 12/2009 | Ehara et al. |
| 7,653,332 | B2 | 1/2010 | Ehara et al. |
| 7,693,468 | B2 | 4/2010 | Ehara et al. |
| 7,697,867 | B2 | 4/2010 | Ehara et al. |
| 7,726,648 | B2 | 6/2010 | Tamura et al. |
| 7,729,024 | B2 | 6/2010 | Kobayashi et al. |
| 7,773,914 | B2 | 8/2010 | Funamoto et al. |

(Continued)

FOREIGN PATENT DOCUMENTS

| | | |
|---|---|---|
| JP | 2672313 | 7/1997 |
| JP | 2006-201743 | 8/2006 |
| JP | 2008-90092 | 4/2008 |
| JP | 2010-92013 | 4/2010 |

OTHER PUBLICATIONS

U.S. Appl. No. 12/791,554, filed Jun. 1, 2010, Yohei Miura, et al.

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

An image forming apparatus includes a recording medium transport belt which is suspended by a plurality of roller members. An image is secondarily transferred from a first image carrier through an intermediate transfer body to a recording medium. An image is directly transferred from a second image carrier to the recording medium. The image forming apparatus further includes a pattern image sensing unit which senses a pattern image transferred from the first image carrier and the second image carrier finally to the recording medium transport belt. Each of a distance from a secondary transfer position to a sensing position and a distance from a direct transfer position to the sensing position in a recording medium transport belt rotation direction is a natural number times a circumferential length of a roller member causing a speed change in the recording medium transport belt among the plurality of roller members.

14 Claims, 14 Drawing Sheets

(56) References Cited

U.S. PATENT DOCUMENTS

| | | | | |
|---|---|---|---|---|
| 7,796,929 | B2 | 9/2010 | Ebara et al. | |
| 2003/0129006 | A1* | 7/2003 | Hoshi et al. | 399/298 |
| 2007/0196132 | A1 | 8/2007 | Kobayashi et al. | |
| 2008/0131168 | A1 | 6/2008 | Ehara et al. | |
| 2008/0213000 | A1 | 9/2008 | Funamoto et al. | |
| 2008/0240754 | A1* | 10/2008 | Kobayashi et al. | 399/46 |
| 2010/0266299 | A1 | 10/2010 | Funamoto et al. | |

* cited by examiner

IMAGE FORMING APPARATUS

CROSS-REFERENCE TO RELATED APPLICATIONS

The present application claims priority to and incorporates by reference the entire contents of Japanese Patent Application No. 2010-058149 filed in Japan on Mar. 15, 2010. The present application incorporates by reference the entire contents of Japanese Patent Application No. 2009-140087 filed in Japan on Jun. 11, 2009.

BACKGROUND OF THE INVENTION

1. Field of the Invention

The present invention relates to an image forming apparatus such as a printer, a facsimile, and a copying machine.

2. Description of the Related Art

Conventionally, an image forming apparatus is well-known where a plurality of image forming sections that corresponds to a plurality of colors such as black and forms images of the corresponding colors on their own image carriers are disposed (see Japanese Patent Application Laid-open No. 2006-201743 or the like).

In the image forming apparatus disclosed in Japanese Patent Application Laid-open No. 2006-201743, there are a direct transfer position where a black color image formed by the black color image forming section is directly transferred to a recording medium and a secondary transfer position where other color images primarily transferred onto an intermediate transfer belt by remaining other color image forming sections are secondarily transferred from the intermediate transfer belt to the recording medium. The secondary transfer position is disposed at an upstream of the direct transfer position in a recording medium transport direction. The intermediate transfer belt is rotatably suspended by a plurality of roller members, so that the intermediate transfer belt is rotated by a driving roller which is one of the roller members. In addition, a recording medium transport belt which is rotatably suspended by a plurality of roller members is disposed to transport the recording medium mounted thereon so as to pass through the direct transfer position and the secondary transfer position. In the image forming apparatus disclosed in Japanese Patent Application Laid-open No. 2006-201743, the recording medium is allowed to pass through the direct transfer position and the secondary transfer position by the recording medium transport belt, so that a full color image is formed on the recording medium by superimposing other color images transferred from the secondary transfer position to the recording medium and the black color image transferred from the direct transfer position to the recording medium. In addition, since the recording medium is mounted on and transported by the recording medium transport belt, a change of the recording medium transport path between the direct transfer position and the secondary transfer position is suppressed, so that it is possible to stably transport the recording medium between the direct transfer position and the secondary transfer position.

In the image forming apparatus disclosed in Japanese Patent Application Laid-open No. 2006-201743, since the images are transferred at the direct transfer position or the secondary transfer position to the recording medium mounted on and transported by the recording medium transport belt, due to the difference in the transfer positions of the images, color irregularity is likely to occur in the images transferred to the recording medium.

Therefore, a technology is considered where a pattern image of each color is formed on the recording medium transport belt, the pattern image is sensed by an optical sensor which is disposed at a downstream of the direct transfer position and the secondary transfer position in the rotation direction of the recording medium transport belt, and correction of an image formation condition is performed based on a sensing result so as to reduce the color irregularity.

However, due to the periodic change in speed with a period of one rotation of a roller member caused by eccentricity, load change, or the like of the roller member, by which the recording medium transport belt is rotatably suspended, the periodic speed change of the rotation speed of the recording medium transport belt occurs with a period of one rotation of the roller member. If the phases of the speed change of the recording medium transport belt are different between at the direct transfer position and at the sensing position where the pattern image is sensed by the optical sensor, the black pattern image which is directly transferred at the direct transfer position to the recording medium transport belt is erroneously sensed so that the pattern image is expanded or contracted at the sensing position than when directly transferred. Similarly, if the phases of the speed change of the recording medium transport belt are different between the secondary transfer position and the sensing position, the other color pattern images which are secondarily transferred at the secondary transfer position to the recording medium transport belt are erroneously sensed so that the pattern images are expanded or contracted at the sensing position than when secondarily transferred. Therefore, there is a problem in that accuracy of the correction deteriorates due to the correction performed based on the sensing result which is obtained by the erroneous sensing.

In addition, a technology is considered where a pattern image of each color is formed on the intermediate transfer belt, the pattern image is sensed by an optical sensor which is disposed at a downstream of the secondary transfer position in an intermediate transfer belt rotation direction, and correction of an image formation condition is performed based on a sensing result so as to reduce the color irregularity.

However, due to the periodic speed change with a period of one rotation of the roller member caused by eccentricity, load change, or the like of the roller member, by which the intermediate transfer belt is rotatably suspended, the periodic speed change of the rotation speed of the intermediate transport belt occurs with a period of one rotation of the roller member. If the phases of the speed change of the intermediate transfer belt are different between at the secondary transfer position and at the sensing position where the pattern image is sensed by the optical sensor, the black pattern image which is reversely transferred at the secondary transfer position onto the intermediate transfer belt is erroneously sensed so that the pattern image is expanded or contracted at the sensing position than when reversely transferred. Similarly, if the phases of the speed change of the intermediate transfer belt are different between at the primary transfer position and at the sensing position, the other color pattern images which are primarily transferred at the primary transfer position to the intermediate transfer belt are erroneously sensed so that the pattern images are expanded or contracted at the sensing position than when primarily transferred. Therefore, there is a problem in that accuracy of the correction deteriorates due to the correction performed based on the sensing result which is obtained by the erroneous sensing.

SUMMARY OF THE INVENTION

It is an object of the present invention to at least partially solve the problems in the conventional technology.

According to an aspect of the present invention there is provided an image forming apparatus including: a first image carrier; a first image forming unit which forms an image on the first image carrier; an intermediate transfer body to which the image formed on the first image carrier is primarily transferred; a primary transfer unit which primarily transfers the image from the first image carrier to the intermediate transfer body; a secondary transfer unit which secondarily transfers the image transferred to the intermediate transfer body to a recording medium; a second image carrier which is disposed at upstream or downstream in a transport direction of the recording medium from a secondary transfer position where the image is secondarily transferred from the intermediate transfer body to the recording medium; a second image forming unit which forms an image on the second image carrier; a direct transfer unit which directly transfers the image formed on the second image carrier to the recording medium; a recording medium transport belt which is rotatably suspended by a plurality of roller members to transport the recording medium mounted thereon so as to pass a direct transfer position where the image is directly transferred from the second image carrier to the recording medium and the secondary transfer position; and a pattern image sensing unit which is disposed to face a front surface of the recording medium transport belt and which senses the pattern image transferred to the recording medium transport belt after formed on the first image carrier and the second image carrier. A distance between the secondary transfer position and the sensing position of the pattern image by the pattern image sensing unit in a rotation direction of the recording medium transport belt and a distance between the direct transfer position and the sensing position in the rotation direction of the recording medium transport belt are a natural number times a circumferential length of a roller member causing the speed change in the recording medium transport belt among the plurality of roller members by which the recording medium transport belt is suspended.

According to another aspect of the present invention there is provided an image forming apparatus including: a first image carrier; a first image forming unit which forms an image on the first image carrier; an intermediate transfer belt to which the image formed on the first image carrier is primarily transferred and which is rotatably suspended by a plurality of roller members; a primary transfer unit which primarily transfers the image at a primary transfer position from the first image carrier to the intermediate transfer belt; a secondary transfer unit which secondarily transfers the image transferred to the intermediate transfer belt to a recording medium; a second image carrier which is disposed at upstream or downstream in a transport direction of the recording medium from a secondary transfer position where the image is secondarily transferred from the intermediate transfer belt to the recording medium; a second image forming unit which forms an image on the second image carrier; a direct transfer unit which directly transfers the image formed on the second image carrier to the recording medium; a recording medium transport belt which is rotatably suspended by a plurality of roller members to transport the recording medium mounted thereon so as to pass a direct transfer position where the image is directly transferred from the second image carrier to the recording medium and the secondary transfer position; and a pattern image sensing unit which is disposed to face a front surface of the intermediate transfer belt and which senses the pattern image transferred to the intermediate transfer belt after formed on the first image carrier and the second image carrier. A distance between the primary transfer position and the sensing position of the pattern image by the pattern image sensing unit in a rotation direction of the intermediate transfer belt and a distance between the secondary transfer position and the sensing position in the rotation direction of the intermediate transfer belt are a natural number times a circumferential length of a roller member causing the speed change in the intermediate transfer belt among the plurality of roller members by which the intermediate transfer belt is suspended.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Hereinafter, a first embodiment where the present invention is applied to a color laser printer (hereinafter, simply referred to as a printer) which is an electronic photographing type image forming apparatus is described.

Figure 1:
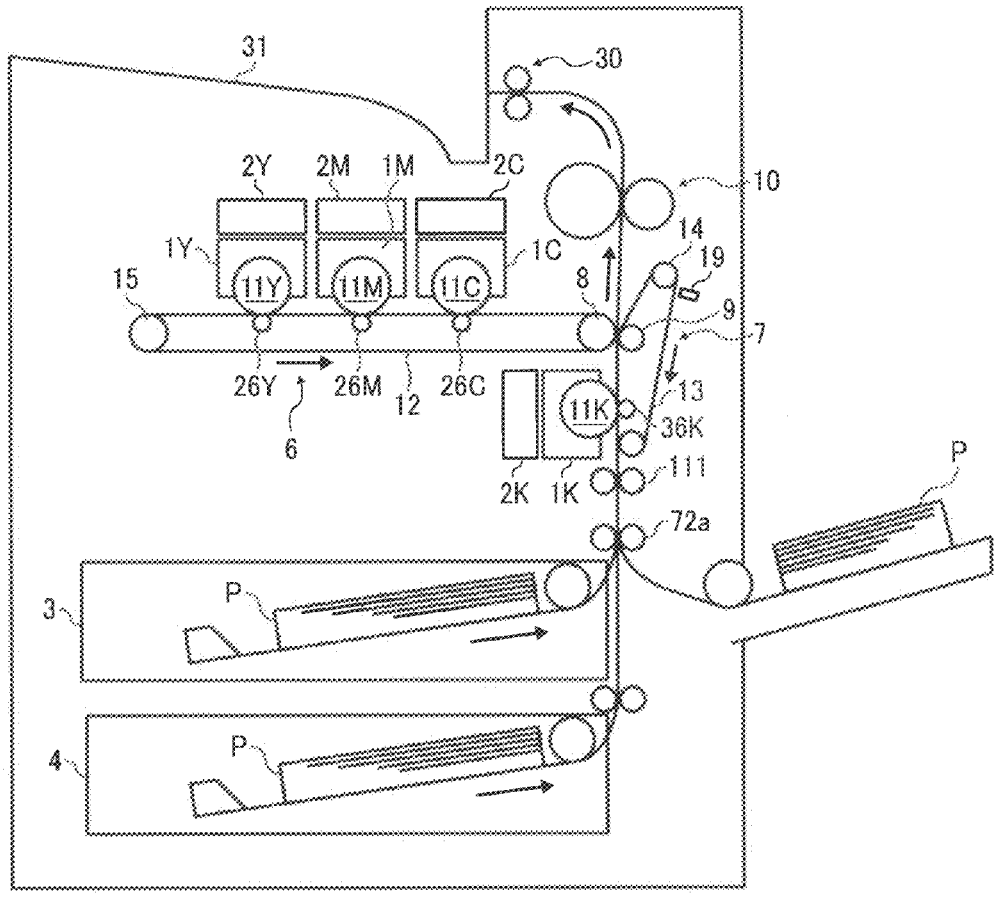
FIG. 1 is a schematic view illustrating a configuration of a printer according to an embodiment.

FIG. 1 is a schematic view illustrating a configuration of the printer according to the embodiment. In the figure, the printer includes a printer section.

The printer section includes four image forming units 1Y, 1M, 1C, and 1K configured to form yellow, magenta, cyan, and black (hereinafter, referred to as Y, M, C, and K) toner images. In addition, an intermediate transfer unit 6 of the printer section includes an intermediate transfer belt 12 which is suspended to extend in a horizontal direction by a driving roller 8, a tension roller 15, and three primary transfer rollers 26Y, 26M, and 26C which are disposed inside the belt loop. An axis of the tension roller 15 is swingably supported and biased by a spring 61 from the inner side to the outer side of the intermediate transfer belt of the intermediate transfer belt to exert a tension to the intermediate transfer belt 12. The intermediate transfer belt 12 as an image carrier can be allowed to move in an endless manner in the counterclockwise direction in the figure by the rotation driving of the driving roller 8. The three image forming units 1Y, 1M, and 1C are disposed to be aligned along the suspended surface of the intermediate transfer belt 12.

The image forming units 1Y, 1M, 1C, and 1K are configured so that each of drum-like photosensitive elements 11Y, 11M, 11C, and 11K, a charging device (not shown), a developing device (not shown), and a drum cleaning device (not shown) are integrally attached to and detached from a casing of the printer section in a state where these components are retained as one unit in a common retaining body. The charging device uniformly charges circumferential surfaces of each of the photosensitive elements 11Y, 11M, 11C, and 11K, which are driven to rotate by a driving unit (not shown), with polarities opposite to the charged polarities of the toners in the dark.

Above the image forming units 1Y, 1M, and 1C and on the left of the image forming unit 1K, optical writing units 2Y, 2M, 2C, and 2K are disposed. Color image information transmitted from an external personal computer (not shown) is decomposed into Y, M, C, and K information by an image processing section (not shown) and processed in the printer section. The optical writing units 2 generate Y, M, C, and K writing light based on the Y, M, C, and K color decomposed image information by driving Y, M, C, and K light sources (not shown) according to a well-known technology. Next, the circumferential surfaces of the photosensitive elements 11Y, 11M, 11C, and 11K uniformly charged by the charging device are scanned by the Y, M, C, and K writing light. Therefore, Y, M, C, and K electrostatic latent images are formed on the circumferential surfaces of the photosensitive elements 11Y, 11M, 11C, and 11K. As a light source for the writing light, a laser diode, an LED, or the like may be exemplified.

The electrostatic latent images formed on the circumferential surfaces of the photosensitive elements 11Y, 11M, 11C, and 11K are developed by the developing device employing a well-known two-component developing scheme using a two-component developer made of a toner and a carrier, so that Y, M, C, and K toner images are formed. In addition, a developing device employing a well-known one-component developing scheme using a one-component developer made of a toner may be used.

Among the four photosensitive elements, the Y, M, and C photosensitive elements 11Y, 11M, and 11C are in contact with the intermediate transfer belt 12 to form Y, M, and C primary transfer nips. In addition, primary transfer rollers 26Y, 26M, and 26C which press the intermediate transfer belt 12 toward the Y, M, and C photosensitive elements 11Y, 11M, and 11C are disposed inside the loop of the intermediate transfer belt 12. Each of the primary transfer rollers 26Y, 26M, and 26C is applied with a primary transfer bias, so that a transfer electric field is formed in the Y, M, C primary transfer nips. The Y, M, and C toner images formed on the circumferential surfaces of the photosensitive elements 11Y, 11M, and 11C are superimposed on and transferred to the front surface (outer surface of the loop) of the intermediate transfer belt 12 at the Y, M, and C primary transfer nips by the operations of the transfer electric field and the nip pressure. Therefore, a three-color superimposed toner image is formed on the front surface of the intermediate transfer belt 12.

A direct transfer unit 7 is disposed on the right of the intermediate transfer belt 12 in the figure. The direct transfer unit 7 includes an endless direct transfer belt 13. The direct transfer belt 13 is suspended to be vertically elongated by a secondary transfer roller 9, a driving roller 14, a tension roller 16, and a K transfer roller 36K and allowed to move in an endless manner in the clockwise direction in the figure by the rotation driving of the driving roller 14. An axis of the tension roller 16 is swingably supported and biased by a spring 62 from the inner side to the outer side of the direct transfer belt to exert a tension to the direct transfer belt 13. In addition, the portion of the direct transfer belt 13 wrapped around the secondary transfer roller 9 is in contact with the portion of the intermediate transfer belt 12 wrapped around the driving roller 8, so that a secondary transfer nip is formed. The secondary transfer roller 9 is applied with a secondary transfer bias, so that a transfer electric field is formed in the secondary transfer nip. In addition, the portion of the direct transfer belt 13 wrapped around the K transfer roller 36K is in contact with the K photosensitive element 11K, so that a K direct transfer nip is also formed. Similarly to the primary transfer rollers 26Y, 26M, and 26C, the transfer roller 36K is also applied with a transfer bias, so that a transfer electric field is formed in the K direct transfer nip.

A first feed cassette 3 and a second feed cassette 4 are disposed to overlap in the vertical direction in a lower portion in the frame of the printer section. These feed cassettes transport a recording sheet P received therein to a sheet transport path. The transported recording sheet P contacts a resist roller pair 111 which is disposed in the sheet transport path extending in the vertical direction in the printer section so that a skew is corrected, and the recording sheet is then inserted between the rollers of the resist roller pair 111. Next, the recording sheet is transported further upwards at predetermined timing by the resist roller pair 111.

The recording sheet P transported from the resist roller pair 111 sequentially passes through the aforementioned K direct transfer nip and Y, M, and C secondary transfer nip formed in the sheet transport path. When the recording sheet P passes through the K direct transfer nip, the K toner image on the circumferential surface of the photosensitive element 11K is transferred to the recording sheet P by the operation of the transfer electric field and the nip pressure. In addition, after that, when the recording sheet P passes through the secondary transfer nip, the three-color (Y, M, and C) superimposed toner image on the intermediate transfer belt 12 is integrally secondarily transferred on the K toner image transferred on the recording sheet P by the operation of the transfer electric field and the nip pressure. Therefore, a full color image, that is, the four-color (Y, M, C, and K) superimposed toner image is formed on the surface of the recording sheet P.

The remaining transfer toners attached on the surfaces of the photosensitive elements 11Y, 11M, 11C, and 11K that pass through the Y, M, and C primary transfer nips and the K direct transfer nip are removed by the drum cleaning devices. In addition, as the Y, M, C, and K drum cleaning devices, a type of scraping the toner by a cleaning blade, a type of scraping the toner by a fur brush roller, a magnetic brush type, etc. may be used.

A fixing device 10 which forms a fixing nip by contacting a heating roller and a pressing roller is disposed above the secondary transfer nip. The recording sheet P that passes through the secondary transfer nip is transported to the fixing nip in the fixing device 10, so that a fixing process of fixing a full color image on the recording sheet P by heat and pressure is performed. Next, the recording sheet P is discharged through a discharging roller pair 30 in the discharging passage to be stacked on a discharge tray 31 disposed on the upper surface of the frame of the printer section.

In the printer, in the monochrome mode of forming a monochrome image, the K photosensitive element 11K is illuminated with light based on the monochrome image data transmitted from an external personal computer (not shown) by the optical writing unit 2K, and the formed K electrostatic latent image is developed with the K toner by the K developing device. After the K toner image is directly transferred onto the recording sheet P at the K direct transfer nip, the K toner image is fixed on the recording sheet P by the fixing device 10.

In the monochrome mode, the secondary transfer roller 9 inside the loop of the direct transfer belt 13 is moved in the direction of separation from the intermediate transfer belt 12, so that the direct transfer belt 13 is separated from the intermediate transfer belt 12. Then, the monochrome image is formed in the state where the driving of the Y, M, and C image forming units 1Y, 1M, and 1C and the intermediate transfer belt 12 is stopped. Therefore, the wearing of the Y, M, and C image forming units 1Y, 1M, and 1C or the intermediate transfer belt 12 due to the useless driving is avoided, so that it is possible to increase the lifespan thereof.

In addition, a configuration of contacting and separating the intermediate transfer belt 12 with respect to the direct transfer belt 13 by moving the driving roller 8 supporting the intermediate transfer belt 12 by using a not shown unit may be used. In this case, since transportation orientation of the recording sheet P is not changed, the behavior of the recording sheet P between the direct transfer belt 13 and the fixing device 10 can be stabilized. Therefore, it is possible to suppress occurrence of wrinkles or image disturbance in the recording sheet P after discharged from the fixing device 10.

In the monochrome mode, since the K toner image is directly transferred onto the recording sheet P transported from the resist roller pair 111 to the K direct transfer nip by the image forming unit 1K, a high-speed print can be implemented in comparison with a configuration where the image forming unit 1K in addition to the image forming units 1Y, 1M, and 1C is disposed to be aligned along the suspended surface of the intermediate transfer belt 12 and the K toner image is transferred through the intermediate transfer belt 12 to the recording sheet P at the secondary transfer nip.

However, in the image forming apparatus having the aforementioned configuration, due to various factors such as impact at the time of transportation or installation, vibration at the time of image formation or paper transportation, or a change in the temperature of the interior of the apparatus, a positional change occurs in the photosensitive element or the optical element of the writing unit of the image forming apparatus, so that a positional irregularity of the image is caused to occur. In addition, due to the eccentricity of the photosensitive element or a rotation member for the transfer belt or the change in the rotation driving speed thereof, the positional irregularity of the image is caused to occur.

In a color image forming apparatus including a plurality of image forming units, a relative positional deviation between images of respective colors causes color irregularity, so that deterioration in the image quality cannot be avoided.

Therefore, in the embodiment, a color matching adjustment pattern image is sensed by an optical sensor 19 that is a pattern image sensing unit, and thereby color irregularity detecting control of detecting the color irregularity is performed at predetermined timing. The optical sensor 19 is disposed to face the front surface of the direct transfer belt 13 at the downstream of the direct transfer nip and the secondary transfer nip in the direct transfer belt rotation direction. As the predetermined timing, a time of performing a manipulation that causes a pattern of the speed change to change such as a time of process unit replacement, a time of issuing a print command in the state where a high image quality print mode is selected, a time when it is determined by counting the number of feeding sheets that, for example, 200 color sheets are fed, a time when it is determined by providing a temperature sensor that a temperature changes by a predetermined amount, for example, by 5 degrees, and a time when it is determined by providing a timer that a predetermined time, for example, 6 hours from the previous adjustment time elapsed, are exemplified.

In the color irregularity detecting control, driving motors (not shown) which rotate the photosensitive elements 11Y, 11C, 11M, and 11K are driven to rotate at constant speeds, and the pattern images are formed on the photosensitive elements 11Y, 11C, 11M, and 11K. Next, the Y, C, M, and K pattern images that are formed on the photosensitive elements 11Y, 11C, 11M, and 11K are finally transferred to the direct transfer belt 13 in a manner that the pattern images are not superimposed.

Figure 2:
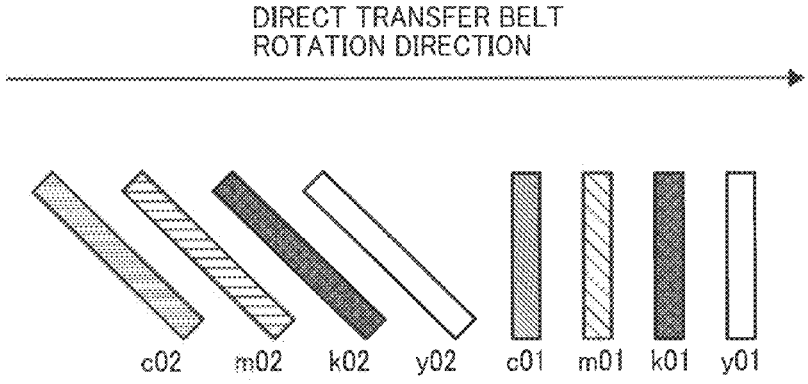
FIG. 2 is a diagrammatic view illustrating a color matching adjustment pattern image formed on a direct transfer belt.

As illustrated in FIG. 2, the color matching adjustment pattern image is transferred to the direct transfer belt 13 so that the pattern images of the colors such as k01, c01, m01, y01, k02, c02, m02, and y02 are aligned in a predetermined pitch along the direct transfer belt rotation direction (sub-scan direction). In addition, a horizontal direction pattern image 01 perpendicular to the direct transfer belt rotation direction and a slant pattern image 02 intersecting the direct transfer belt rotation direction by 45 degrees are used as the pattern images, so that the sensing of the direct transfer belt rotation direction (sub-scan direction) and the direction (main scan direction) perpendicular to the direct transfer belt rotation direction can be performed.

Furthermore, by forming a plurality of the pattern images in the direct transfer belt rotation direction (sub-scan direction), the sub-scan magnification ratio irregularity o in the direct transfer belt rotation direction (sub-scan direction) in each color can be sensed. In addition, by forming a plurality of the pattern images in the direction (main scan direction) perpendicular to the direct transfer belt rotation direction, the main scan magnification ratio irregularity, curve, and skew irregularity in the direction (main scan direction) perpendicular to the direct transfer belt rotation direction in each color can be sensed. Furthermore, by repeatedly performing the pattern image sensing by several times, and obtaining the average of the sensing results, it is possible to improve the accuracy of the color matching adjustment.

Herein, theoretically, although the pattern images are formed on the direct transfer belt 13 so as to be aligned at a predetermined pitch in the direct transfer belt rotation direction, an error occurs in the actual installation pitch of the pattern images according to the change thereof due to the aforementioned factors causing the color irregularity.

Figure 3:
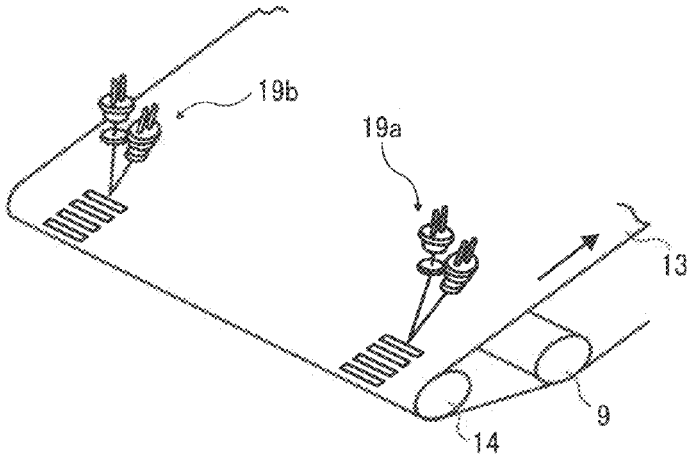
FIG. 3 is a perspective view illustrating a direct transfer unit around a position where an optical sensor is disposed.

As illustrated in FIG. 3, when the color matching adjustment pattern image passes under the optical sensor 19 according to the rotation of the direct transfer belt 13, each image position is sensed by the optical sensor 19. Therefore, the pitch error of the sensing time of each color of the color matching adjustment pattern image is sensed. Based on the sensed pitch error, the resist irregularity correction in the sub-scan direction and the main scan direction may be performed by adjusting the timing of writing the latent image on the photosensitive element 11, the resist irregularity correction in the sub-scan direction may be performed by adjusting a driving clock of the driving motor which drives the photosensitive element 11 to rotate, the skew irregularity correction may be performed by adjusting a folding mirror in the writing unit, the main scan direction magnification ratio correction may be performed by adjusting a writing speed, and so on.

Figure 4:
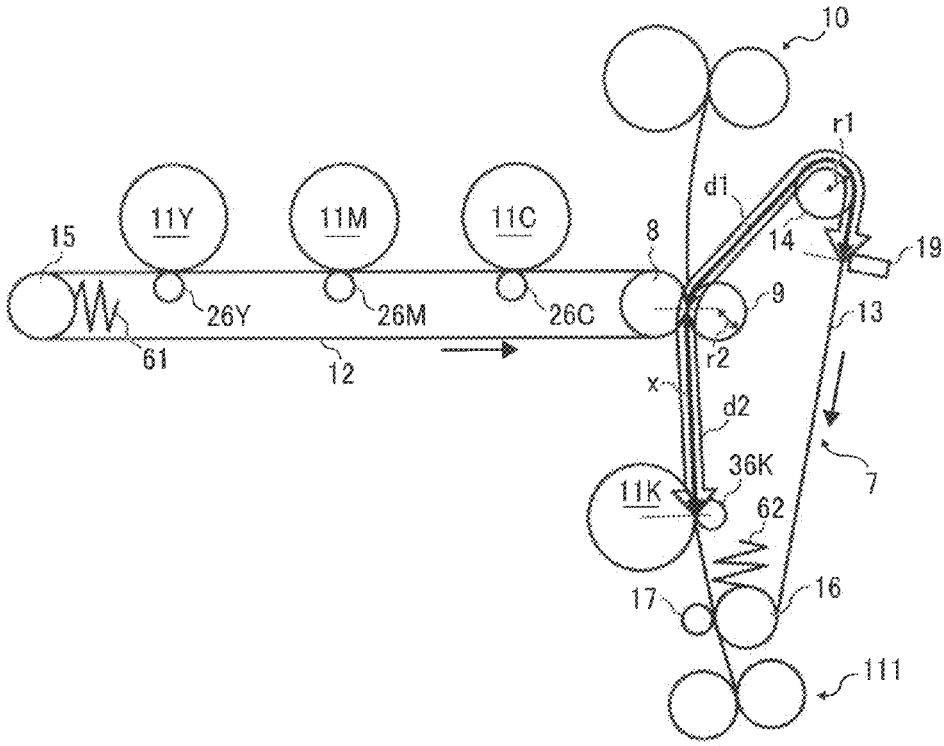
FIG. 4 is a schematic view illustrating a configuration of a transfer section which is a characteristic portion of the embodiment.

FIG. 4 is a schematic view illustrating a configuration of a transfer section which is a characteristic portion of the embodiment. The intermediate transfer belt 12 is suspended by a driving roller 8, and a tension roller 15, and the direct transfer belt 13 is suspended by a driving roller 14, a secondary transfer roller 9, and a tension roller 16. A sheet adsorption roller 17 which is applied with a predetermined voltage from a power source (not shown) is disposed at the position facing the tension roller 16.

In addition, an optical sensor 19 configured to read an adjustment pattern image is disposed at the downstream of the secondary transfer of the direct transfer belt 13.

In FIG. 4, r1 denotes a radius of the driving roller 14 of the direct transfer belt, and r2 denotes a radius of the driving roller 8 of the intermediate transfer belt. d1 denotes a distance from the secondary transfer position to the sensing position of the optical sensor, and d2 denotes a distance from the K transfer position to the sensing position of the optical sensor. With respect to the r1, d1, and d2, the following relationship is satisfied.

In the case where the radius of the driving roller 14 which drives the direct transfer belt 13 to rotate is denoted by r1, a distance from the secondary transfer nip to the sensing position of the optical sensor 19 in the path along the direct transfer belt 13 towards the downstream in the direct transfer belt rotation direction is denoted by d1, and a distance from the K direct transfer nip to the sensing position of the optical sensor 19 in the path along the direct transfer belt 13 towards the downstream in the direct transfer belt rotation direction is denoted by d2, the printer according to the embodiment is configured so as to satisfy the following relationships of Equations 1 and 2. In addition, in Equation 1, n1 is a natural number, and in the embodiment, n1=1. In addition, in Equation 2, n2 is also a natural number, and in the embodiment, n2=3.

$$d1=2\pi r1\cdot n1(n1 \text{ is a natural number}) \quad (1)$$

$$d2=2\pi r1\cdot n2(n2 \text{ is a natural number}) \quad (2)$$

Here, in the rotation speed of the direct transfer belt 13, a periodic speed change with a period of one rotation of the driving roller 14 occurs due to the eccentricity, the load change, or the like of the driving roller 14. If the speed change in rotation speed of the direct transfer belt 13 occurs and even if the writing of the K pattern image with respect to the photosensitive element 11K is achieved at an ideal position, and the rotation speed of the photosensitive element 11K is constant, the expansion or contraction of the K pattern image transferred from the photosensitive element 11K to the direct transfer belt 13 occurs according to the phase of the speed change in rotation speed of the direct transfer belt 13 when the K pattern image is transferred from the photosensitive element 11K to the direct transfer belt at the direct transfer nip, as seen from FIG. 5.

Figure 5:
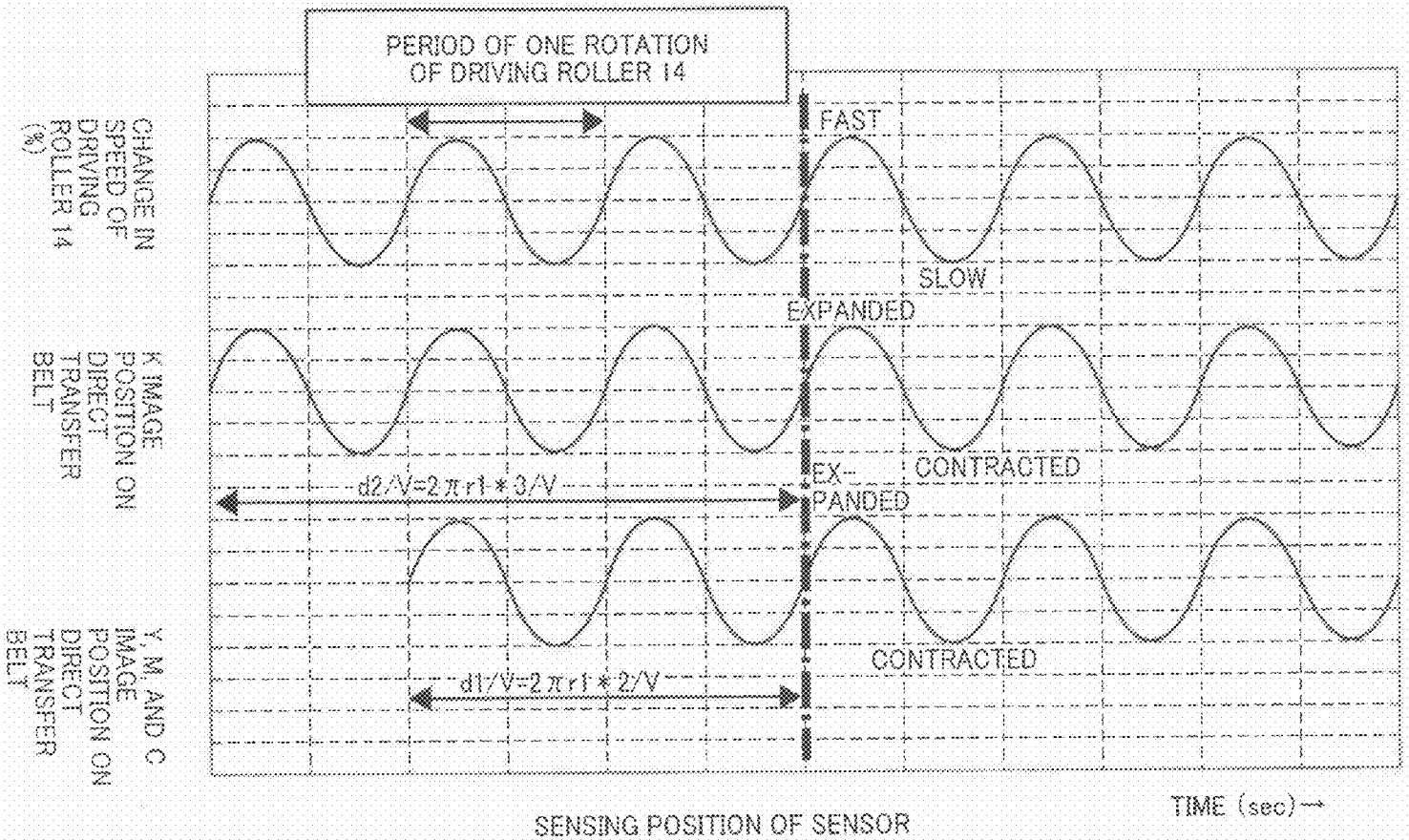
FIG. 5 is a graph illustrating a periodic speed change with a period of one rotation of a driving roller or the like, occurring in a rotation speed of a direct transfer belt.

Similarly, if the speed change occurs in rotation speed of the direct transfer belt 13 and even if the writing of the Y, M, and C pattern images with respect to the photosensitive elements 11C, 11M, and 11Y is achieved at an ideal position, and the rotation speeds of the photosensitive elements 11C, 11M, and 11Y and the rotation speed of the intermediate transfer belt 12 are constant, the expansion or contraction of the Y, M, and C pattern images transferred from the intermediate transfer belt 12 to the direct transfer belt 13 occurs according to the phase of the speed change occurring in the direct transfer belt 13 when the Y, M, and C pattern images are transferred from the intermediate transfer belt 12 to the direct transfer belt 13 at the secondary transfer nip, as seen from FIG. 5.

In addition, if the phases of the speed change of the direct transfer belt 13 are different between at the direct transfer nip and at the sensing position, the K pattern image directly transferred from the photosensitive element 11K to the direct transfer belt 13 at the direct transfer nip is erroneously sensed by the optical sensor 19 so that the pattern image expands or contracts at the sensing position than when directly transferred.

Similarly, if the phases of the speed change of the direct transfer belt 13 are different between at the secondary transfer nip and at the sensing position, the Y, M, and C pattern images which are secondarily transferred from the intermediate transfer belt 12 to the direct transfer belt 13 at the secondary transfer nip are erroneously sensed by the optical sensor 19 so that the pattern images expand or contract at the sensing position than when secondarily transferred. Therefore, there is a problem in that accuracy of the correction deteriorates due to the correction performed based on the sensing result which is obtained by the erroneous sensing.

Therefore, in the embodiment, as expressed by the aforementioned Equation 1, the distance d1 between the secondary transfer nip and the sensing position in the direct transfer belt rotation direction is configured to be a natural number times the circumferential length of the driving roller 14 which is a roller member causing a speed change in the direct transfer belt 13 among a plurality of the roller members by which the direct transfer belt 13 is suspended. Since the distance d1 is configured to be a natural times the circumferential length of the driving roller 14, the phases, at the secondary transfer nip and at the sensing position, of the periodic speed change of the direct transfer belt 13 occurring with a period of one rotation of the driving roller 14 can be aligned with each other, as seen from FIG. 5. Therefore, it is possible to cancel out the influences of the periodic speed change occurring with a period of one rotation of the driving roller 14 to the rotation speed of the direct transfer belt 13 at the secondary transfer nip and at the sensing position. Accordingly, it is possible to prevent the Y, M, and C pattern images which are secondarily transferred at the secondary transfer nip from the intermediate transfer belt 12 to the direct transfer belt 13 from being erroneously sensed due to the periodic speed change of the direct transfer belt 13 occurring with a period of one rotation of the driving roller 14 so that the pattern images expand or contract at the sensing position than when secondarily transferred.

In addition, as expressed by the aforementioned Equation 2, the distance d2 between the direct transfer nip and the sensing position in the direct transfer belt rotation direction is configured to be a natural number times the circumferential length of the driving roller 14. Since the distance d2 is configured to be a natural number times the circumferential length of the driving roller 14, the phases, at the direct transfer nip and at the sensing position, of the periodic speed change of the direct transfer belt 13 occurring with a period of one rotation of the driving roller 14 can be aligned with each other, as seen from FIG. 5. Therefore, it is possible to cancel out the influences of the periodic speed change occurring with a period of one rotation of the driving roller 14 to the rotation speed of the direct transfer belt 13 at the direct transfer nip and at the sensing position. Accordingly, it is possible to prevent the K pattern image which is directly transferred at the direct transfer nip from the photosensitive element 11K to the direct transfer belt 13 from being erroneously sensed, due to the periodic speed change of the direct transfer belt 13 occurring with a period of one rotation of the driving roller 14, so that the pattern image expands or contracts at the sensing position than when directly transferred.

In this manner, in the embodiment, the phases of the periodic speed change of the rotation speed of the direct transfer belt 13 occurring with a period of one rotation of the driving roller 14 are equal to each other between at the direct transfer time and the secondary transfer time and at each pattern image reading time by the optical sensor 19. Therefore, in the color matching adjustment, the periodic speed change of the direct transfer belt 13 occurring with a period of one rotation of the driving roller 14 can be neglected and thus only the other changes are detected from the pattern images by the optical sensor 19, and the color matching adjustment can be performed based on the sensing result, resulting in that the accuracy of the color matching adjustment can be improved.

Therefore, the rotation speeds of the direct transfer belt 13 are equal to each other between at the direct transfer time and the secondary transfer time and at each pattern image reading time of the optical sensor 19. Therefore, in the color matching adjustment, the periodic speed change of the direct transfer belt 13 occurring with a period of one rotation of the driving roller 14 can be neglected and thus only the other changes are detected from the pattern images by the optical sensor 19, and the color matching adjustment can be performed based on the sensing result, resulting in that the accuracy of the color matching adjustment can be improved.

Furthermore, in the embodiment, when the distance from the K direct transfer nip to the secondary transfer nip is denoted by x, the relationship of Equation 3 is satisfied from the aforementioned Equations 1 and 2.

$$x=d2-d1=2\pi r1\cdot(n2-n1) \quad (3)$$

Since the recording sheet P that is entered into the nip formed by the tension roller 16 and the sheet adsorption roller 17 through the direct transfer belt 13 is adsorbed to, mounted on, and transported by the direct transfer belt 13, the transport speed of the recording sheet P changes according to the rotation speed of the direct transfer belt 13. Therefore, in the transport speed of the recording sheet P after the recording sheet P is entered into the nip formed by the tension roller 16 and the sheet adsorption roller 17 through the direct transfer belt 13 and is mounted on the direct transfer belt 13, the periodic speed change with a period of one rotation of the driving roller 14 which drives the direct transfer belt 13 to rotate occurs. If such a speed change occurs in the transport speed of the recording sheet P, there is a possibility that the phases of the speed change of the transport speed of the recording sheet P are different between at the direct transfer time of the K toner image at the K direct transfer nip and at the secondary transfer time of the Y, M, and C toner images at the secondary transfer nip, so that periodic color irregularity with a period of one rotation of the driving roller 14 occurs among the Y, M, C, and K toner images transferred onto the recording sheet P.

On the contrary, in the embodiment, since the distance from the K direct transfer nip to the secondary transfer nip is configured to be a natural number times the circumferential length (1 rotation pitch) of the driving roller 14 as expressed by the aforementioned Equation 3, the phase of the speed change of the direct transfer belt 13 at the direct transfer nip and the phase of the speed change of the direct transfer belt 13 at the secondary transfer nip can be aligned with each other, so that the transport speeds of the recording sheet P at the direct transfer time of the K toner image at the K direct transfer nip and at the secondary transfer time of the Y, M, and C toner images at the secondary transfer nip are equal to each other. Accordingly, it is possible to suppress the periodic color irregularity with a period of one rotation of the driving roller 14 among the Y, M, C, and K toner images transferred to the recording sheet P, so that it is possible to improve the accuracy of the color matching.

In addition, although the periodic speed change with a period of one rotation of the driving roller 14 has a dominant influence on the rotation speed of the direct transfer belt 13, there is considered a case where, with a period of one rotation (1 rotation pitch) of each driven roller such as the secondary transfer roller 9, the transfer roller 36K, the tension roller 16, and the sheet adsorption roller 17 which are driven to rotate by the rotation of the direct transfer belt 13, a speed change occurs in the rotation speed of the direct transfer belt 13 due to the load change or the like.

In the case where the radius of the driven roller (the transfer roller 36K, the secondary transfer roller 9, the tension roller 16, and the sheet adsorption roller 17) which is driven to rotate by the rotation of the direct transfer belt 13 is denoted by r2, the distance from the secondary transfer nip to the sensing position of the optical sensor 19 in the path along the direct transfer belt 13 towards the direct transfer belt rotation direction downstream is denoted by d1, and the distance from the K direct transfer nip to the sensing position of the optical sensor 19 in the path along the direct transfer belt 13 towards the direct transfer belt rotation direction downstream is denoted by d2, by employing a configuration in which the following relationships of Equations 4 and 5 are satisfied, it is possible to suppress deterioration in the accuracy of the color matching adjustment occurring with the pitch of the each driven roller.

$$d1=2\pi r2\cdot n3 (n3 \text{ is a natural number}) \quad (4)$$

$$d2=2\pi r2\cdot n4 (n4 \text{ is a natural number}) \quad (5)$$

In addition, all the configurations satisfying the aforementioned relationships of Equations 1, 2, 3, 4, and 5 have independent geometrical relationships in the direct transfer unit or the intermediate transfer unit. Therefore, although the K image forming unit 1K, in other words, the K direct transfer nip is disposed at the recording sheet transport direction downstream from the secondary transfer nip as illustrated in FIG. 6, the aforementioned various effects can be obtained like the case where the K direct transfer nip is disposed at the recording sheet transport direction upstream from the secondary transfer nip.

In the embodiment, the recording sheet P is mounted and transported by the direct transfer belt 13 so as to pass the direct transfer nip and the secondary transfer nip. Therefore, despite of whether the direct transfer nip is disposed at the recording sheet transport direction upstream or downstream with respect to the secondary transfer nip, the recording sheet P can be allowed to pass the direct transfer nip and the secondary transfer nip by the direct transfer belt 13. Accordingly, deterioration of a degree of freedom in the layout of the inner portion of the image forming apparatus, in which the direct transfer nip is necessarily located at the recording sheet transport direction downstream from the secondary transfer nip and which may occur in a conventional image forming apparatus, does not occur.

Herein, in the printer according to the embodiment, a well-known configuration of recovering remaining transfer toners, which are removed from the surfaces of the photosensitive elements 11Y, 11M, 11C, and 11K by the drum cleaning device, into the developing devices corresponding to the colors and reusing the toners for image formation may be employed.

Figure 6:
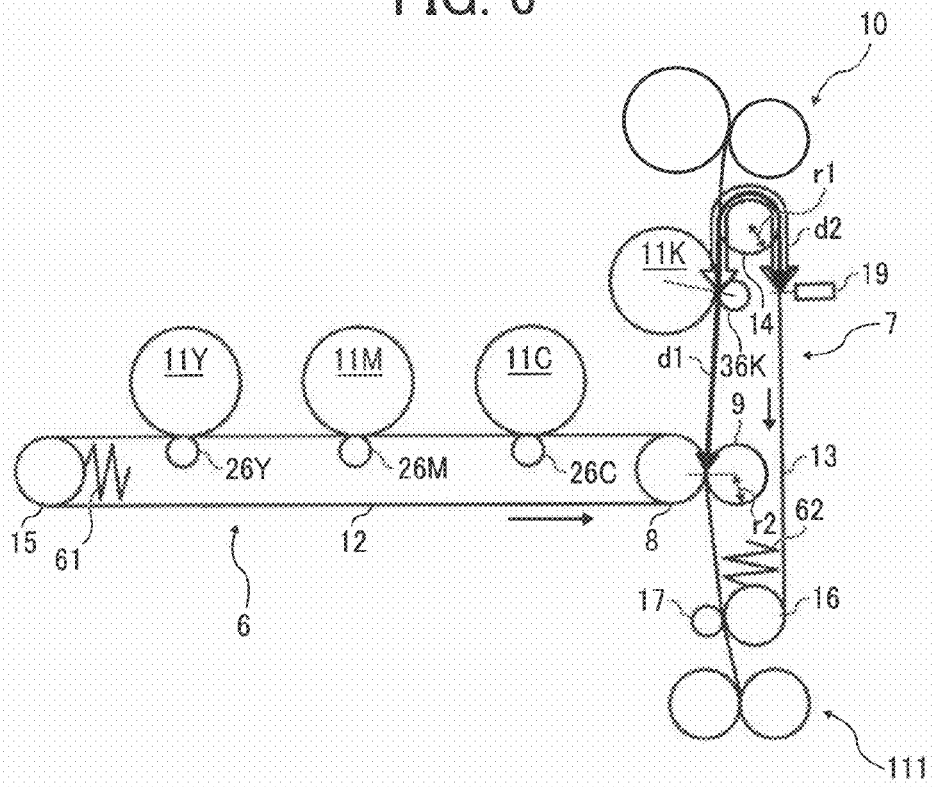
FIG. 6 is a schematic view illustrating a configuration of a transfer section in the case where a K image forming unit is disposed at a downstream of a secondary transfer nip in a recording sheet transport direction.

At this time, if the K image forming unit 1K, in other words, the K direct transfer nip is disposed at the recording sheet transport direction downstream from the secondary transfer nip as illustrated in FIG. 6, the toners of the colors of the Y, M, and C toner images transferred onto the recording sheet P at the secondary transfer nip may be reversely transferred from the recording sheet P to the surface of the photosensitive element 11K at the time of transferring the K toner image at the direct transfer nip. If the toners of the Y, M, and C colors reversely transferred in this manner are removed from the photosensitive element 11K and recovered into the K developing device, a color mixing occurs in the K developing device, so that the color of the image (K toner image) formed by the image forming unit 1K by using the toner is changed with time.

On the contrary, by employing a configuration in which the K image forming unit 1K, in other words, the K direct transfer nip is disposed at the recording sheet transport direction upstream from the secondary transfer nip as illustrated in FIG. 1 or the like, the toners of the Y, M, and C colors transferred onto the recording sheet P at the secondary transfer nip cannot be reversely transferred to the surface of the photosensitive element 11K. Therefore, the color mixing does not occur in the K developing device, so that it is possible to prevent the color of the image (K toner image) formed by the image forming unit 1K from changing with time.

Figure 7:
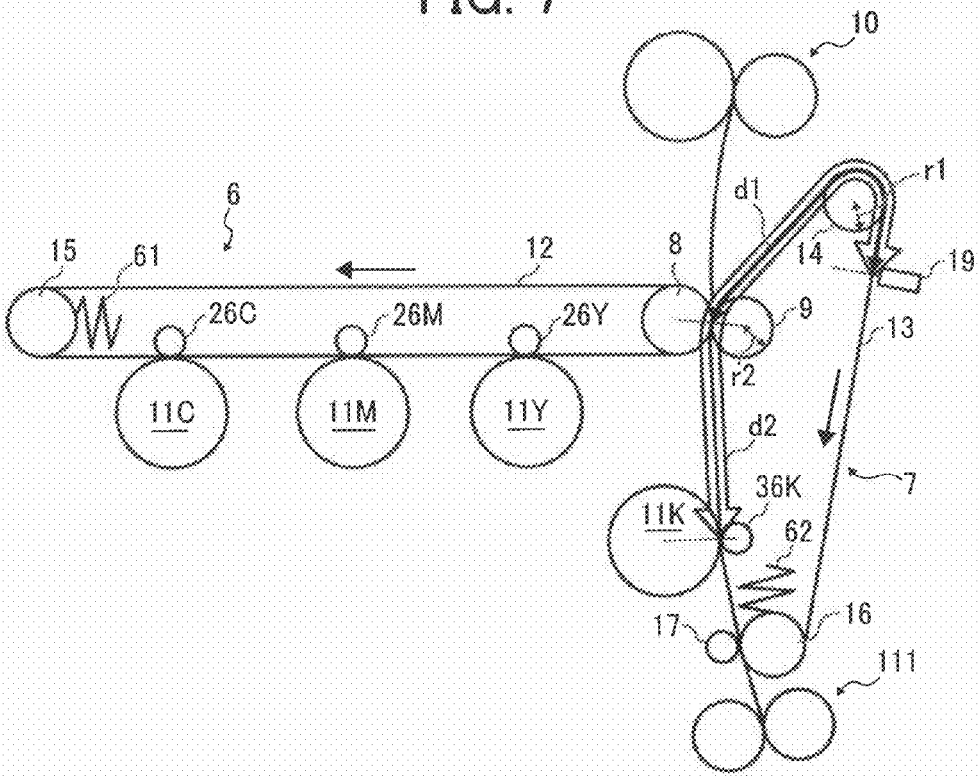
FIG. 7 is a schematic view illustrating a configuration of a transfer section in the case where a photosensitive element is disposed below an intermediate transfer belt.

In addition, in the printer according to the embodiment, although the photosensitive elements 11Y, 11M, and 11C are located above the intermediate transfer belt 12, the photosensitive elements 11Y, 11M, and 11C may be disposed under the intermediate transfer belt 12 as illustrated in FIG. 7.

Figure 8:
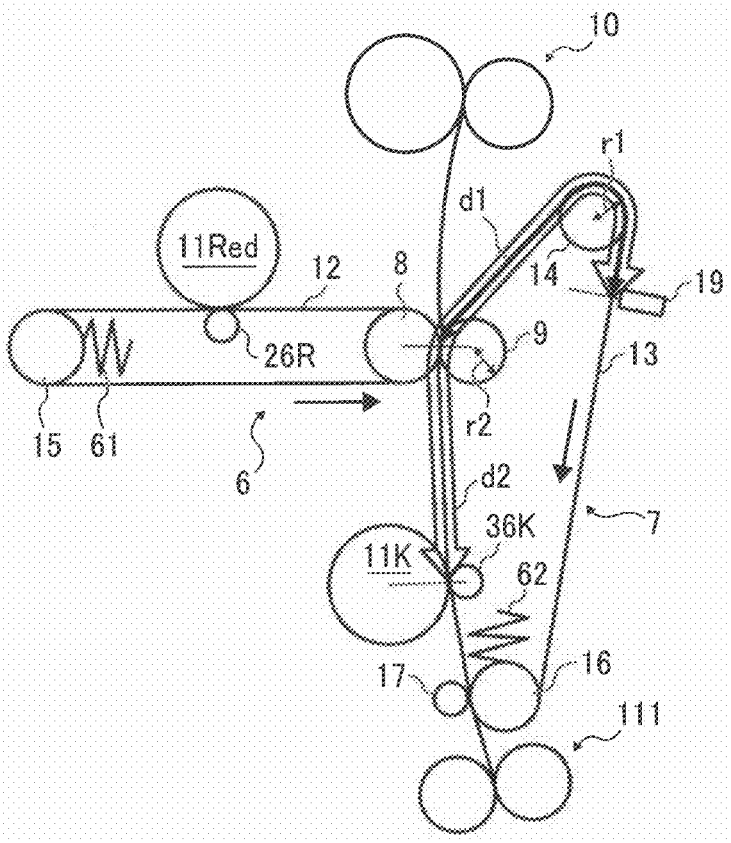
FIG. 8 is a schematic view illustrating a configuration of a transfer section in the case where there is one image forming unit facing an intermediate transfer belt.

In addition, as illustrated in FIG. 8, a single image forming unit 1 (photosensitive element 11) may be disposed to face the intermediate transfer belt 12. In FIG. 8, the image forming unit 1R forming the toner image by using a red toner is disposed to face the intermediate transfer belt 12.

The aforementioned configuration is applied to an image forming apparatus simultaneously using a direct transfer scheme and an indirect transfer scheme, so that accuracy of color matching adjustment is improved. Therefore, it is possible to provide an image forming apparatus capable of forming a high quality image without color irregularity or image irregularity.

As described above, the aforementioned configuration is applied to an image forming apparatus simultaneously using the direct transfer scheme and the indirect transfer scheme, so that accuracy of color matching adjustment is improved. Therefore, it is possible to provide an image forming apparatus capable of forming a high quality image without color irregularity or image irregularity.

In addition, in the embodiment, the Y, M, C, and K pattern images may be transferred onto the recording sheet P mounted on the direct transfer belt 13 and each of the pattern images may be read by the optical sensor 19. In this case, the optical sensor 19 ma be provided at the position that is at the recording sheet transport direction downstream from the position where the pattern images of all the colors are transferred onto the recording sheet P and faces the surface, on which the pattern images are transferred, of the recording sheet P mounted on the direct transfer belt 13, on which the pattern images are transferred.

As described above, the transport speed of the recording sheet P mounted on the direct transfer belt 13 changes according to the rotation speed of the direct transfer belt 13. Therefore, even in the case where the pattern images of the colors on the recording sheet P mounted on the direct transfer belt 13 are read by the optical sensor 19, by employing a configuration in which the aforementioned relationships of Equations 1, 2, 3, 4, and 5 are satisfied, it is possible to suppress erroneous sensing as described above.

Second Embodiment

Hereinafter, a second embodiment where the present invention is applied to a color laser printer (hereinafter, simply referred to as a printer) which is an electronic photographing type image forming apparatus is described. The basic configuration of the printer according to the embodiment is substantially the same as that of the printer according to the first embodiment, and thus, the description thereof is not repeated.

Figure 9:
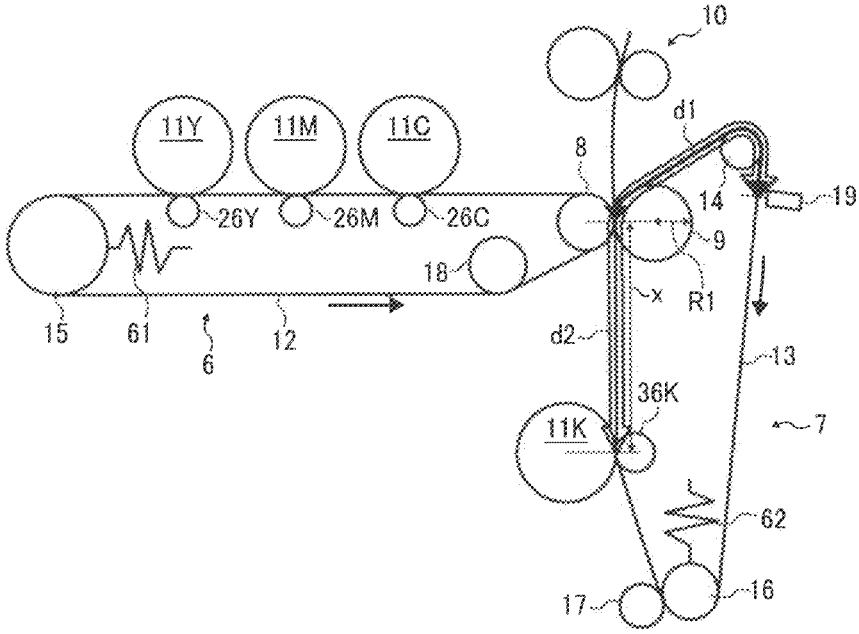
FIG. 9 is a schematic view illustrating a configuration of a transfer section which is a characteristic portion of a second embodiment.

FIG. 9 is a schematic view illustrating a configuration of a transfer section which is a characteristic portion of the embodiment.

The intermediate transfer belt 12 is suspended by a driving roller 8, a tension roller 15, a driven roller 18, and the like. An axis of the tension roller 15 is swingably supported and biased by a spring from the inner side to the outer side of the intermediate transfer belt to exert a tension to the intermediate transfer belt 12. The driving roller 8 is driven to rotate by a driving motor (not shown) provided in a printer main body, and the tension roller 15, the driven roller 18, or the like is driven to rotate by the rotation of the intermediate transfer belt 12 which is driven to rotate by the driving roller 8.

A rotary encoder (not shown) that is a detecting unit configured to detect a rotation angle change or a rotation angle speed of the driven roller 18 is disposed coaxially with the driven roller 18. The rotary encoder may not be disposed coaxially with the driven roller 18, but it may be disposed coaxially with any one of the primary transfer rollers 26Y, 26M, and 26C which are driven by the rotation of the intermediate transfer belt 12 similarly to the driven roller 18. However, since the tension roller 15 that is driven by the rotation of the intermediate transfer belt 12 similarly to the driven roller 18 or the like is swingably supported in the state where the tension roller 15 is biased by the spring, the tension roller 15 is easy to be affected by the load change, and the accuracy of measurement of the rotation angle change or the rotation angle speed of the tension roller 15 by the rotary encoder deteriorates in comparison with the case where the rotary encoder is disposed coaxially with any one of other driven rollers such as the primary transfer rollers 26Y, 26M, and 26C. Therefore, the later-described feedback control may not be appropriately performed, so that it is not preferable that the rotary encoder is disposed coaxially with the tension roller 15.

Figure 10:
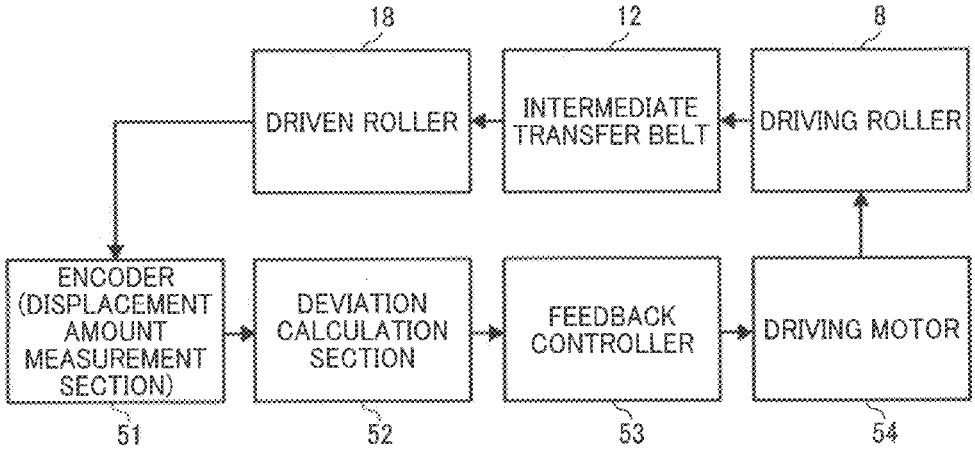
FIG. 10 is a schematic block diagram illustrating an example of a configuration of a rotation driving control device of an intermediate transfer unit.

FIG. 10 is a schematic block diagram illustrating an example of a configuration of the rotation driving control device of the intermediate transfer unit 6.

A feedback controller 53 feeds the sensing result of the rotation angle change or the rotation angle speed of the driven roller 18 which is obtained based on an output from an encoder 51 that is a displacement amount measuring unit back to the rotation speed of a driving motor 54 which drives the driving roller 8 to rotate. More specifically, when the rotation angle change or the rotation angle speed of the driven roller 18 is smaller than a control target value which is obtained in advance through an experiment or the like, the driving motor 54 is controlled (acceleration-controlled) in a feedback manner by the feedback controller 53 according to a deviation between the rotation angle change or the rotation angle speed sensed by the encoder 51 and the control target value, which is calculated by a deviation calculation section 52, so that the rotation speed of the driving motor 54 is increased, and thus, the rotation speed of the driving roller 8 is increased. On the other hand, when the rotation angle change or the rotation angle speed of the driven roller 18 is larger than the control target value, the driving motor 54 is controlled (deceleration-controlled) in a feedback manner by the feedback controller 53 according to the deviation which is calculated by the deviation calculation section 52, so that the rotation speed of the driving motor 54 is decreased, and thus, the rotation speed of the driving roller 8 is decreased.

In this manner, in the embodiment, the driving roller 8 is controlled in a feedback manner to be driven to rotate based on the detection signal from the encoder 51 provided coaxially with the driven roller 18 so that the rotation angle change or the rotation angle speed of the driven roller 18 is maintained to be constant. By the feedback control, it is possible to suppress the periodic speed change with a period of one rotation period of the driving roller 8 or the like occurring in the intermediate transfer belt 12 due to the eccentricity or the like of the driving roller 8, so that it is possible to stabilize the rotation speed of the intermediate transfer belt 12 which is rotated by the driving roller 8.

Next, the direct transfer belt 13 is suspended by a secondary transfer roller 9, a driving roller 14, a tension roller 16, and the like. An axis of the tension roller 16 is swingably supported and biased by a spring from the inner side to the outer side of the direct transfer belt to exert a tension to the direct transfer belt 13. The driving roller 14 is driven to rotate by a driving motor (not shown) provided in a printer main body, and the secondary transfer roller 9 and the tension roller 16 are driven to rotate by the rotation of the direct transfer belt 13 which is driven to rotate by the driving roller 14. In addition, a sheet adsorption roller 17 which is applied with a predetermined voltage from a power source (not shown) and allows the recording sheet P to be adsorbed on the direct transfer belt 13 by an electrostatic force is disposed at the position of facing the tension roller 16 through the direct transfer belt 13. The sheet adsorption roller 17 is in contact with the front surface (outer surface of the loop) of the direct transfer belt 13, and the sheet adsorption roller 17 is also driven to rotate by the rotation of the direct transfer belt 13.

A rotary encoder (not shown) that is a detecting unit configured to detect a rotation angle change or a rotation angle speed of the secondary transfer roller 9 is disposed coaxially with the secondary transfer roller 9 that is a driven roller which is driven by the rotation of the direct transfer belt 13. In addition, the rotary encoder may not be disposed coaxially with the secondary transfer roller 9, but it may be disposed coaxially with the transfer roller 36K that is a driven roller similarly to the secondary transfer roller 9. Otherwise, a new driven roller which is driven by the rotation of the direct transfer belt 13 is disposed, and the rotary encoder may be disposed coaxially with the driven roller. However, since the tension roller 16 that is driven by the rotation of the direct transfer belt 13 similarly to the secondary transfer roller 9 or the like is swingably supported in the state where the tension roller 16 is biased by the spring, the tension roller 16 is easy to be affected by the load change, and the accuracy of measurement of the rotation angle change or the rotation angle speed of the tension roller 16 by the rotary encoder deteriorates in comparison with the case where the rotary encoder is disposed coaxially with any one of other driven rollers such as the transfer roller 36K. Therefore, the later-described feedback control may not be appropriately performed, so that it is not preferable that the rotary encoder is disposed coaxially with the tension roller 16.

Figure 11:
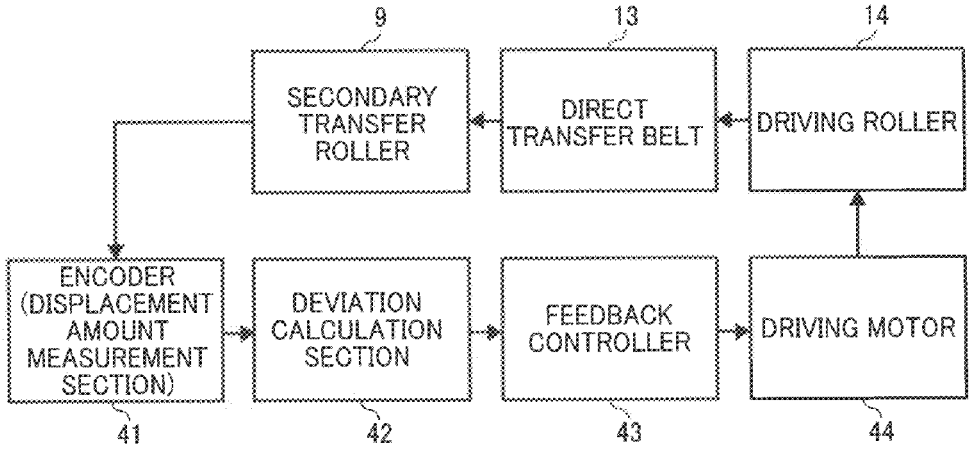
FIG. 11 is a schematic block diagram illustrating an example of a configuration of a rotation driving control device of a direct transfer unit.

FIG. 11 is a schematic block diagram illustrating an example of a configuration of the rotation driving control device of the direct transfer unit 7.

A feedback controller 43 feeds the sensing result of the rotation angle change or the rotation angle speed of the secondary transfer roller 9 which is obtained based on an output from an encoder 41 that is a displacement amount measuring unit back to the rotation speed of a driving motor 44 which drives the driving roller 14 to rotate. More specifically, when the rotation angle change or the rotation angle speed of the secondary transfer roller 9 is smaller than a control target value which is obtained in advance through an experiment or the like, the driving motor 44 is controlled (acceleration-controlled) in a feedback manner by the feedback controller 43 according to a deviation between the rotation angle change or the rotation angle speed sensed by the encoder 41 and the control target value, which is calculated by a deviation calculation section 42, so that the rotation speed of the driving motor 44 is increased, and thus, the rotation speed of the driving roller 14 is increased. On the other hand, when the rotation angle change or the rotation angle speed of the secondary transfer roller 9 is larger than the control target value, the driving motor 44 is controlled (deceleration-controlled) in a feedback manner by the feedback controller 43 according to the deviation which is calculated by the deviation calculation section 42, so that the rotation speed of the driving motor 44 is decreased, and thus, the rotation speed of the driving roller 14 is decreased.

In this manner, in the embodiment, the driving roller 14 is controlled in a feedback manner to be driven to rotate based on the detection signal from the encoder 41 provided coaxially with the secondary transfer roller 9 so that the rotation angle change or the rotation angle speed of the secondary transfer roller 9 is maintained to be constant. By the feedback control, it is possible to suppress the periodic speed change with a period of one rotation of the driving roller 14 or the like occurring in the direct transfer belt 13 due to the eccentricity or the like of the driving roller 14, so that it is possible to stabilize the rotation speed of the direct transfer belt 13 which is rotated by the driving roller 8.

However, in the control, although the periodic speed change with a period of one rotation of the driving roller 14 occurring in the direct transfer belt 13 is suppressed by the feedback control, the periodic speed change with a period of one rotation of the secondary transfer roller 9 occurring in the direct transfer belt 13 due to the eccentricity or the like of the secondary transfer roller 9 provided with the rotary encoder is not suppressed by the feedback control. In other words, if there is an eccentricity in the driven roller provided with the rotary encoder such as the secondary transfer roller 9, the speed change component caused by the eccentricity of the driven roller is fed back to the rotation speed of the driving roller 14 and thus to the rotation speed of the driving motor, so that a speed change caused by the eccentricity of the driven roller occurs in the direct transfer belt 13. Therefore, the rotation speed of the direct transfer belt 13 has a periodic speed change with a period of one rotation of the secondary transfer roller 9 (driven roller). If the radius of the secondary transfer roller 9 (driven roller) is denoted by R1 and the target speed of the direct transfer belt 13 is denoted by V0, the speed change occurs with a period of $(2\pi R1)/V0$.

In the case where the radius of the secondary transfer roller 9 which is a driven roller driven by the rotation of the direct transfer belt 13 and coaxially provided with a rotary encoder is denoted by R1, a distance from the secondary transfer nip to the sensing position of the optical sensor in the path along the direct transfer belt 13 towards the direct transfer belt rotation direction downstream is denoted by d1, and a distance from the K direct transfer nip to the sensing position of the optical sensor in the path along the direct transfer belt 13 towards the direct transfer belt rotation direction downstream is denoted by d2, the printer according to the embodiment is configured so as to satisfy the following relationships of Equations 6 and 7. In addition, in Equation 6, N1 is a natural number, and in the embodiment, N1=1. In addition, in Equation 7, N2 is also a natural number, and in the embodiment, N2=3.

$$d1=2\pi R1\cdot N1(N1 \text{ is a natural number}) \quad (6)$$

$$d2=2\pi R1\cdot N2(N2 \text{ is a natural number}) \quad (7)$$

Herein, in the rotation speed of the direct transfer belt 13, a periodic speed change with a period of one rotation of the secondary transfer roller 9 occurs due to the eccentricity, the load change, or the like of the secondary transfer roller 9. If the speed change occurs in the rotation speed of the direct transfer belt 13 and even if the writing of the K pattern image with respect to the photosensitive element 11K is achieved at an ideal position and the rotation speed of the photosensitive element 11K is constant, the expansion or contraction of the K pattern image transferred from the photosensitive element 11K to the direct transfer belt 13 occurs according to the phase of the speed change occurring in the rotation speed of the direct transfer belt 13 when the K pattern image is transferred from the photosensitive element 11K to the direct transfer belt at the direct transfer nip.

Similarly, if the periodic speed change with a period of one rotation of the secondary transfer roller 9 occurs in the rotation speed of the direct transfer belt 13 and even if the writing of the Y, M, and C pattern images with respect to the photosensitive elements 11C, 11M, and 11Y is achieved at an ideal position and the rotation speeds of the photosensitive elements 11C, 11M, and 11Y and the rotation speed of the intermediate transfer belt 12 are constant, the expansion or contraction of the Y, M, and C pattern images transferred from the intermediate transfer belt 12 to the direct transfer belt 13 occurs according to the phase of the speed change occurring in the direct transfer belt 13 when the Y, M, and C pattern images are transferred from the intermediate transfer belt 12 to the direct transfer belt 13 at the secondary transfer nip.

In addition, if the phases of the speed change of the direct transfer belt 13 are different between at the direct transfer nip and at the sensing position, the K pattern image directly transferred from the photosensitive element 11K to the direct transfer belt 13 at the direct transfer nip is erroneously sensed by the optical sensor 19 so that the pattern image is expanded or contracted at the sensing position than when directly transferred. Similarly, if the phases of the speed change of the direct transfer belt 13 are different between at the secondary transfer nip and at the sensing position, the Y, M, and C pattern images which are secondarily transferred from the intermediate transfer belt 12 to the direct transfer belt 13 at the secondary transfer nip are erroneously sensed by the optical sensor 19 so that the pattern images are expanded or contracted at the sensing position than when secondarily transferred. Therefore, there is a problem in that accuracy of the correction deteriorates due to the correction performed based on the sensing result which is obtained by the erroneous sensing.

Therefore, in the embodiment, as expressed by the aforementioned Equation 6, the distance d1 between the secondary transfer nip and the sensing position in the direct transfer belt rotation direction is configured to be a natural number times the circumferential length of the secondary transfer roller 9 which is a roller member causing a speed change in the direct transfer belt 13 among a plurality of the roller members by which the direct transfer belt 13 is suspended and which is driven to rotate by the rotation of the direct transfer belt 13. Since the distance d1 is configured to be a natural times the circumferential length of the secondary transfer roller 9, the phases of the periodic speed change of the direct transfer belt 13 occurring with a period of one rotation of the secondary transfer roller 9 can be aligned between at the secondary transfer nip and at the sensing position. Therefore, it is possible to cancel out the influences of the periodic speed change occurring with a period of one rotation of the secondary transfer roller 9 to the rotation speed of the direct transfer belt 13 at the secondary transfer nip and at the sensing position. Accordingly, it is possible to prevent the Y, M, and C pattern images which are secondarily transferred at the secondary transfer nip from the intermediate transfer belt 12 to the direct transfer belt 13 from being erroneously sensed, due to the periodic speed change of the direct transfer belt 13 occurring with a period of one rotation of the secondary transfer roller 9, so that the pattern images are expanded or contracted at the sensing position than when secondarily transferred.

In addition, as expressed by the aforementioned Equation 7, the distance d2 between the direct transfer nip and the sensing position in the direct transfer belt rotation direction is configured to be a natural number times the circumferential length of the secondary transfer roller 9. Since the distance d2 is configured to be a natural times the circumferential length of the secondary transfer roller 9, the phases of the periodic speed change of the direct transfer belt 13 occurring with a period of one rotation of the secondary transfer roller 9 can be aligned between at the direct transfer nip and at the sensing position. Therefore, it is possible to cancel out the influences of the periodic speed change occurring with a period of one rotation of the secondary transfer roller 9 to the rotation speed of the direct transfer belt 13 at the direct transfer nip and at the sensing position. Accordingly, it is possible to prevent the K pattern image which is directly transferred at the direct transfer nip from the photosensitive element 11K to the direct transfer belt 13 from being erroneously sensed, due to the periodic speed change of the direct transfer belt 13 occurring with a period of one rotation of the secondary transfer roller 9, so that the pattern images are expanded or contracted at the sensing position than when directly transferred.

In this manner, in the embodiment, the phases of the periodic speed change of the rotation speed of the direct transfer belt 13 occurring with a period of one rotation of the secondary transfer roller 9 are equal to each other between at the direct transfer time and the secondary transfer time and at each pattern image reading time of the optical sensor 19. Therefore, since, in the color matching adjustment, the periodic speed change of the direct transfer belt 13 occurring with a period of one rotation of the secondary transfer roller 9 can be neglected and thus only the other changes are detected from the pattern images by the optical sensor 19, the color matching adjustment can be performed based on the sensing result, so that the accuracy of the color matching adjustment can be improved.

Furthermore, in the embodiment, when the distance from the K direct transfer nip to the secondary transfer nip is denoted by x, the relationship of Equation 8 is satisfied from the aforementioned Equations 6 and 7.

$$x=d2-d1=2\pi R1\cdot(N2-N1) \quad (8)$$

Since the recording sheet P that is entered through the direct transfer belt 13 into the nip formed by the tension roller 16 and the sheet adsorption roller 17 is adsorbed to, mounted on, and transported by the direct transfer belt 13, the transport speed of the recording sheet P has a speed change according to the rotation speed of the direct transfer belt 13. Therefore, in the transport speed of the recording sheet P after the recording sheet P is entered through the direct transfer belt 13 into the nip formed by the tension roller 16 and the sheet adsorption roller 17 and is mounted on the direct transfer belt 13, the periodic speed change with a period of one rotation of the driving roller 14 which drives the direct transfer belt 13 to rotate occurs. If such a speed change occurs in the transport speed of the recording sheet P, there is a possibility that the phases of the speed change of the transport speed of the recording sheet P are different between at the direct transfer time at the K toner image of the K direct transfer nip and at the secondary transfer time of the Y, M, and C toner images at the secondary transfer nip, so that periodic color irregularity with a period of one rotation of the driving roller 14 occurs among the Y, M, C, and K toner images transferred onto the recording sheet P.

On the contrary, in the embodiment, since the distance from the K direct transfer nip to the secondary transfer nip is configured to be a natural number times the circumferential length (1 rotation pitch) of the driving roller 14 as expressed by the aforementioned Equation 8, the phase of the speed change of the direct transfer belt 13 at the direct transfer nip and the phase of the speed change of the direct transfer belt 13 at the secondary transfer nip can be aligned with each other, so that the transport speeds of the recording sheet P at the direct transfer time of the K toner image of the K direct transfer nip and at the secondary transfer time of the Y, M, and C toner images of the secondary transfer nip are equal to each other. Accordingly, it is possible to prevent the periodic color irregularity with a period of one rotation of the driving roller 14 from occurring among the Y, M, C, and K toner images transferred to the recording sheet P, so that it is possible to improve the accuracy of the color matching.

In addition, all the configurations satisfying the aforementioned relationships of Equations 6, 7, and 8 have independent geometrical relationships in the intermediate transfer unit 6 or the direct transfer unit 7. Therefore, although the K image forming unit 1K, in other words, the K direct transfer nip is disposed at the recording sheet transport direction downstream from secondary transfer nip, since the periodic speed change of the direct transfer belt 13 with a period of one rotation of the secondary transfer roller 9 can be neglected in the color matching adjustment as described above, and the color matching adjustment can be performed by sensing the other changes, the accuracy can be improved.

In the embodiment, the recording sheet P is mounted and transported by the direct transfer belt 13 so as to pass the direct transfer nip and the secondary transfer nip. Therefore, despite of whether the direct transfer nip is disposed at the recording sheet transport direction upstream or downstream with respect to the secondary transfer nip, the recording sheet P can be allowed to pass the direct transfer nip and the secondary transfer nip by the direct transfer belt 13. Accordingly, deterioration of a degree of freedom in the layout of the inner portion of the image forming apparatus, in which the direct transfer nip is necessarily located at the recording sheet transport direction downstream from the secondary transfer nip and which may occur in a conventional image forming apparatus, does not occur.

In addition, in the printer according to the embodiment, a well-known configuration of recovering remaining transfer toners, which are removed from the surfaces of the photosensitive elements 11Y, 11M, 11C, and 11K by the drum cleaning device, into the developing devices corresponding to the colors and reusing the toners for image formation may also be employed. At this time, due to the same reason as that described in the first embodiment, in the embodiment, by employing a configuration in which the K image forming unit 1K, in other words, the K direct transfer nip is disposed at the recording sheet transport direction upstream from the secondary transfer nip, a color mixing does not occur in the K developing device, so that it is possible to suppress the color of the image (K toner image) formed by the image forming unit 1K from being changed according to the time elapse.

In addition, in the printer according to the embodiment, although the photosensitive elements 11Y, 11M, and 11C are located above the intermediate transfer belt 12, the photosensitive elements 11Y, 11M, and 11C may be disposed under the intermediate transfer belt 12.

In addition, a single image forming unit 1 (photosensitive element 11) may be disposed to face the intermediate transfer belt 12.

As described above, the aforementioned configuration is applied to an image forming apparatus simultaneously using the direct transfer scheme and the indirect transfer scheme, so that it is possible to provide an image forming apparatus capable of forming a high quality image without color irregularity, image irregularity, and image expansion or contraction.

Third Embodiment

Hereinafter, a third embodiment where the present invention is applied to a color laser printer (hereinafter, simply referred to as a printer) which is an electronic photographing type image forming apparatus is described.

Figure 12:
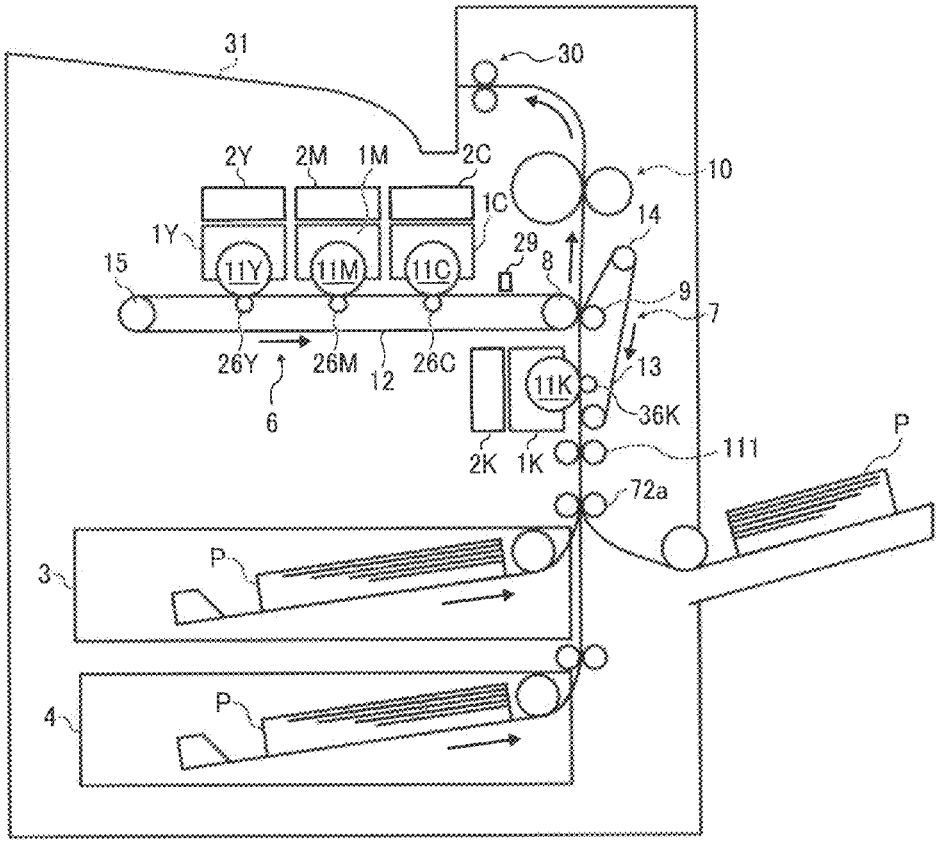
FIG. 12 is a schematic view illustrating a configuration of a printer according to a third embodiment.

FIG. 12 is a schematic view illustrating a configuration of the printer according to the embodiment. In the figure, the printer includes a printer section.

The printer section includes four image forming units 1Y, 1M, 1C, and 1K configured to form yellow, magenta, cyan, and black (hereinafter, referred to as Y, M, C, and K) toner images. In addition, an intermediate transfer unit 6 of the printer section includes an intermediate transfer belt 12 which is suspended to extend in a horizontal direction by a driving roller 8, a tension roller 15, and three primary transfer rollers 26Y, 26M, and 26C which are disposed inside the belt loop. An axis of the tension roller 15 is swingably supported and biased by a spring 61 from the inner side to the outer side of the intermediate transfer belt to exert a tension to the intermediate transfer belt 12. The intermediate transfer belt 12 as an image carrier can be allowed to move in an endless manner in the counterclockwise direction in the figure by the rotation driving of the driving roller 8. The three image forming units 1Y, 1M, and 1C are disposed to be aligned along the suspended surface of the intermediate transfer belt 12.

The image forming units 1Y, 1M, 1C, and 1K are configured so that drum-like photosensitive elements 11Y, 11M, 11C, and 11K, a charging device (not shown), a developing device (not shown), and a drum cleaning device (not shown) are integrally attached and detached with respect to a casing of the printer section in a state where these components are retained as one unit in a common retaining body. The charging device uniformly charges circumferential surfaces of the photosensitive elements 11Y, 11M, 11C, and 11K, which are driven to rotate by a driving unit (not shown), with polarities opposite to the charged polarities of the toners in the dark.

In the upper portions of the image forming units 1Y, 1M, and 1C and on the left of the image forming unit 1K, optical writing units 2Y, 2M, 2C, and 2K are disposed. Color image information transmitted from an external personal computer (not shown) is decomposed into Y, M, C, and K information by an image process portion (not shown) and then processed in the printer section. The optical writing units 2 generates Y, M, C, and K writing light based on the Y, M, C, and K color decomposed image information by driving Y, M, C, and K light sources (not shown) according to a well-known technology. The circumferential surfaces of the photosensitive elements 11Y, 11M, 11C, and 11K uniformly charged by the charging device are scanned by the Y, M, C, and K writing light. Therefore, Y, M, C, and K electrostatic latent images are formed on the circumferential surfaces of the photosensitive elements 11Y, 11M, 11C, and 11K. As a light source for the writing light, a laser diode, an LED, or the like may be exemplified.

The electrostatic latent images formed on the circumferential surfaces of the photosensitive elements 11Y, 11M, 11C, and 11K are developed by a developing device employing a well-known two-component developing scheme using a two-component developer made of a toner and a carrier, so that Y, M, C, and K toner images are formed. In addition, a developing device employing a well-known one-component developing scheme using a one-component developer made of a toner may be used.

Among the four photosensitive elements, the Y, M, and C photosensitive elements 11Y, 11M, and 11C are in contact with the intermediate transfer belt 12 to form Y, M, and C primary transfer nips. In addition, primary transfer rollers 26Y, 26M, and 26C which press the intermediate transfer belt 12 toward the Y, M, and C photosensitive elements 11Y, 11M, and 11C are disposed inside the loop of the intermediate transfer belt 12. Each of the primary transfer rollers 26Y, 26M, and 26C is applied with a primary transfer bias, so that transfer electric field is formed in the Y, M, C primary transfer nips. The Y, M, and C toner images formed on the circumferential surfaces of the photosensitive elements 11Y, 11M, and 11C are superimposed and transferred onto the front surface (outer surface of the loop) of the intermediate transfer belt 12 at the Y, M, and C primary transfer nips by the operations of the transfer electric field and the nip pressure. Therefore, a three-color superimposed toner image is formed on the front surface of the intermediate transfer belt 12.

A direct transfer unit 7 is disposed on the right of the intermediate transfer belt 12 in the figure. The direct transfer unit 7 includes an endless direct transfer belt 13. The direct transfer belt 13 is suspended to be vertically elongated by a secondary transfer roller 9, a driving roller 14, a tension roller 16, and a K transfer roller 36K and allowed to move in an endless manner in the clockwise direction in the figure by the rotation driving of the driving roller 14. An axis of the tension roller 16 is swingably supported and biased by a spring 62 from the inner side to the outer side of the direct transfer belt to exert a tension to the direct transfer belt 13. In addition, the portion of the direct transfer belt 13 wrapped around the secondary transfer roller 9 is in contact with the portion of the intermediate transfer belt 12 wrapped around the driving roller 8, so that a secondary transfer nip is formed. The secondary transfer roller 9 is applied with a secondary transfer bias, so that a transfer electric field is formed in the secondary transfer nip. In addition, the portion of the direct transfer belt 13 wrapped around the K transfer roller 36K is in contact with the K photosensitive element 11K, so that a K direct transfer nip is also formed. Similarly to the primary transfer rollers 26Y, 26M, and 26C, the transfer roller 36K is also applied with a transfer bias, so that a transfer electric field is formed in the K direct transfer nip.

A first feed cassette 3 and a second feed cassette 4 are disposed to overlap in the vertical direction in a lower portion of the frame of the printer section. These feed cassettes transmit a recording sheet P received therein to a sheet transport path. The transmitted recording sheet P contacts with a resist roller pair 111 which is disposed in the sheet transport path extending in the vertical direction in the printer section so that a skew is corrected, and the recording sheet is then inserted between the rollers of the resist roller pair 111. Next, the recording sheet is transmitted further upwards at a predetermined timing by the resist roller pair 111.

The recording sheet P transmitted from the resist roller pair 111 sequentially passes the aforementioned K direct transfer nip and Y, M, and C secondary transfer nip formed in the sheet transport path. When the recording sheet P passes the K direct transfer nip, the K toner image on the circumferential surface of the photosensitive element 11K can be transferred to the recording sheet P by the operation of the transfer electric field and the nip pressure. In addition, after that, when the recording sheet P passes the secondary transfer nip, the three-color (Y, M, and C) superimposed toner image on the intermediate transfer belt 12 is integrally secondarily transferred on the K toner image transferred on the recording sheet P by the operation of the transfer electric field and the nip pressure. Therefore, a full color image, that is, the four-color (Y, M, C, and K) superimposed toner image is formed on the surface of the recording sheet P.

The remaining transfer toners attached on the surfaces of the photosensitive elements 11Y, 11M, 11C, and 11K that pass the Y, M, and C primary transfer nips and the K direct transfer nip are removed by the drum cleaning devices. In addition, as the Y, M, C, and K drum cleaning devices, a type of scraping the toner by a cleaning blade, a type of scraping the toner by a fur brush roller, a magnetic brush type, or the like may be used.

A fixing device 10 which forms a fixing nip by contacting a heating roller and a pressing roller is disposed above the secondary transfer nip. The recording sheet P that passes the secondary transfer nip is transmitted to the fixing nip in the fixing device 10, so that a fixing process of fixing a full color image on the recording sheet P by heat and pressure is performed. Next, the recording sheet P is discharged through a discharging roller pair 30 in the discharging passage to be stacked on a discharge tray 31 disposed on the upper surface of the frame of the printer section.

In the printer, in the monochrome mode forming a monochrome image, the K photosensitive element 11K is illuminated with light based on the monochrome image data transmitted from an external personal computer (not shown) by the optical writing unit 2K, and the formed K electrostatic latent image is developed on the K toner by the K developing device. After the K toner image is directly transferred onto the recording sheet P at the K direct transfer nip, the K toner image is fixed on the recording sheet P by the fixing device 10.

In the monochrome mode, the secondary transfer roller 9 inside the loop of the direct transfer belt 13 is moved in the direction of separation from the intermediate transfer belt 12, so that the direct transfer belt 13 is separated from the intermediate transfer belt 12. Then, the monochrome image is formed in the state where the driving of the Y, M, and C image forming units 1Y, 1M, and 1C and the intermediate transfer belt 12 is stopped. Therefore, the consumption of the Y, M, and C image forming units 1Y, 1M, and 1C or the intermediate transfer belt 12 due to the useless driving is avoided, so that it is possible to increase the lifecycle thereof.

In addition, a configuration of contacting and separating the intermediate transfer belt 12 with respect to the direct transfer belt 13 by moving the driving roller 8 supporting the intermediate transfer belt 12 by using a not shown unit may be used. In this case, since transportation orientation of the recording sheet P is not changed, the behavior of the recording sheet P between the direct transfer belt 13 and the fixing device 10 can be stabilized. Therefore, it is possible to suppress occurrence of wrinkles or image disturbance in the recording sheet P that is discharged from the fixing device 10.

In the monochrome mode, since the K toner image is directly transferred onto the recording sheet P transported from the resist roller pair 111 to the K direct transfer nip by the image forming unit 1K, high-speed print can be implemented in comparison with a configuration where the image forming unit 1K in addition to the image forming units 1Y, 1M, and 1C is disposed to be aligned along the suspended surface of the intermediate transfer belt 12 and the K toner image is transferred through the intermediate transfer belt 12 to the recording sheet P at the secondary transfer nip.

However, in the image forming apparatus having the aforementioned configuration, due to various factors such as impact at the time of transportation or installation, vibration at the time of image formation or paper transportation, or a change in the internal temperature of the inner portion of the apparatus, a positional change occurs in the photosensitive element or the optical element of the writing unit of the image forming apparatus, so that a positional irregularity of the image is caused to occur. In addition, due to the eccentricity of the photosensitive element or a rotation member for the transfer belt or the change in the rotation driving speed thereof, the positional irregularity of the image is caused to occur.

In a color image forming apparatus including a plurality of image forming units, a relative positional deviation between images of respective colors causes color irregularity, so that deterioration in the image quality cannot be avoided.

Therefore, in the embodiment, a color matching adjustment pattern image is sensed by an optical sensor 29 that is a pattern image sensing unit, and thereby color irregularity detecting control of detecting the color irregularity is performed at a predetermined timing. The optical sensor 29 is disposed to face the front surface of the intermediate transfer belt 12 at the intermediate transfer belt rotation direction downstream from the primary transfer nip and the secondary transfer nip. As the predetermined timing, the time of performing a manipulation that causes a pattern of the speed change to change such as a time of process unit replacement, a time of issuing a print command in the state where a high image quality print mode is selected, a time when it is determined by counting the number of feeding sheets that, for example, 200 color sheets are fed, a time when it is determined by providing a temperature sensor that a temperature change by a predetermined amount, for example, by 5 degrees, and a time when it is determined by providing a timer that a predetermined time, for example, 6 hours from the previous adjustment time elapsed, are exemplified.

In the color irregularity detecting control, driving motors (not shown) which rotate the photosensitive elements 11Y, 11C, 11M, and 11K are driven to rotate at constant speeds, so that the pattern images are formed on the photosensitive elements 11Y, 11C, 11M, and 11K. Next, Y, C, M, and K pattern images formed on the photosensitive elements 11Y, 11C, 11M, and 11K are transferred so that the pattern images are not superimposed with each other on the intermediate transfer belt 12 finally. Herein, in order to transfer each pattern image on the intermediate transfer belt 12, a secondary transfer bias (reverse bias) in the direction opposite to the case of printing a transfer sheet needs to be applied at the secondary transfer position.

Figure 13:
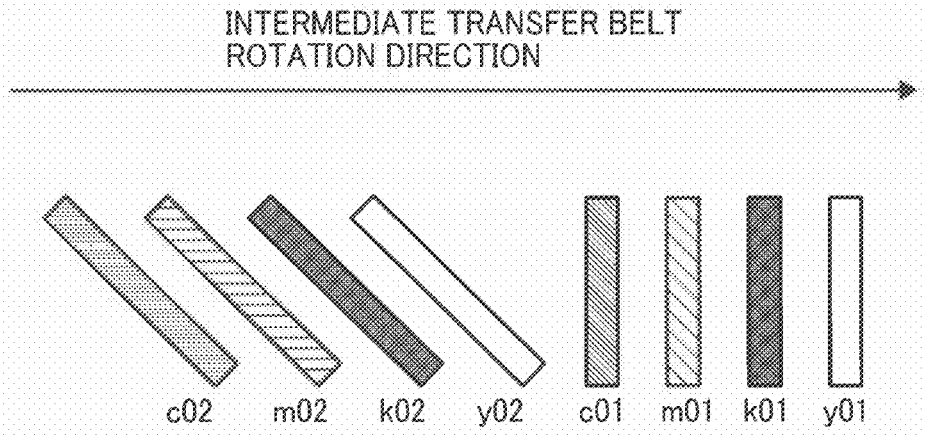
FIG. 13 is a diagrammatic view illustrating a color matching adjustment pattern image formed on an intermediate transfer belt.

As illustrated in FIG. 13, the color matching adjustment pattern image is transferred to the intermediate transfer belt 12 so that the pattern images of the colors such as k01, c01, m01, y01, k02, c02, m02, and y02 are aligned in a predetermined pitch along the intermediate transfer belt rotation direction (sub-scan direction). In addition, a horizontal direction pattern image 01 perpendicular to the intermediate transfer belt rotation direction and a slant pattern image 02 intersecting the intermediate transfer belt rotation direction by 45 degrees are used as the pattern images, so that the sensing of the intermediate transfer belt rotation direction (sub-scan direction) and the direction (main scan direction) perpendicular to the intermediate transfer belt rotation direction can be performed.

Furthermore, by forming a plurality of the pattern images in the intermediate transfer belt rotation direction (sub-scan direction), the sub-scan magnification ratio irregularity in the intermediate transfer belt rotation direction (sub-scan direction) in each color can be sensed. In addition, by forming a plurality of the pattern images in the direction (main scan direction) perpendicular to the intermediate transfer belt rotation direction, the main scan magnification ratio irregularity, curve, and skew irregularity in the direction (main scan direction) perpendicular to the intermediate transfer belt rotation direction in each color can be sensed. Furthermore, by repeatedly performing the pattern image sensing by several times, and obtaining the average of the sensing results, it is possible to improve the accuracy of the color matching adjustment.

Herein, theoretically, although the pattern images are formed on the intermediate transfer belt 12 so as to be aligned at a predetermined pitch in the intermediate transfer belt rotation direction, an error occurs in the actual installation pitch of the pattern images according to the change thereof due to the aforementioned factors causing the color irregularity.

Figure 14:
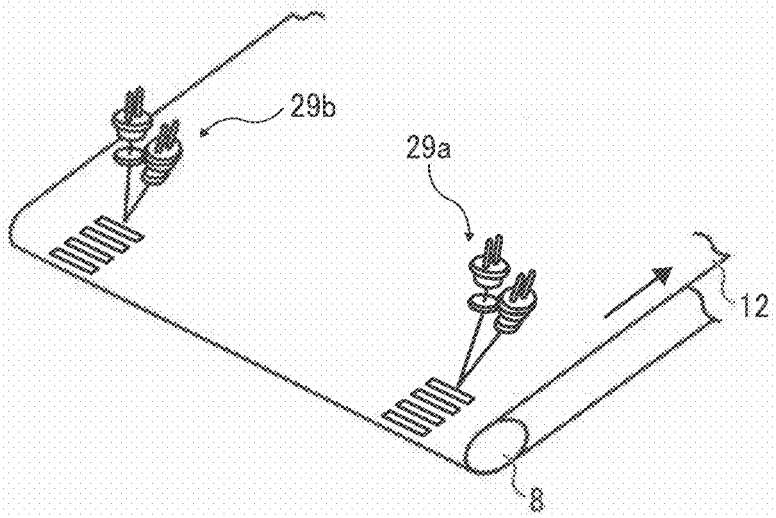
FIG. 14 is a perspective view illustrating an intermediate transfer unit around a position where an optical sensor is disposed.

As illustrated in FIG. 14, when the color matching adjustment pattern image passes under the optical sensor 29 according to the rotation of the intermediate transfer belt 12, each image position is sensed by the optical sensor 29. Therefore, the pitch error of the sensing time of each color of the color matching adjustment pattern image is sensed. Based on the sensed pitch error, the resist irregularity correction in the sub-scan direction and the main scan direction may be performed by adjusting the timing of writing the latent image on the photosensitive element 11, the resist irregularity correction in the sub-scan direction may be performed by adjusting a driving clock of the driving motor which drives the photosensitive element 11 to rotate, the skew irregularity correction may be performed by adjusting a folding mirror in the writing unit, the main scan direction magnification ratio correction may be performed by adjusting a writing speed, and so on.

Figure 15:
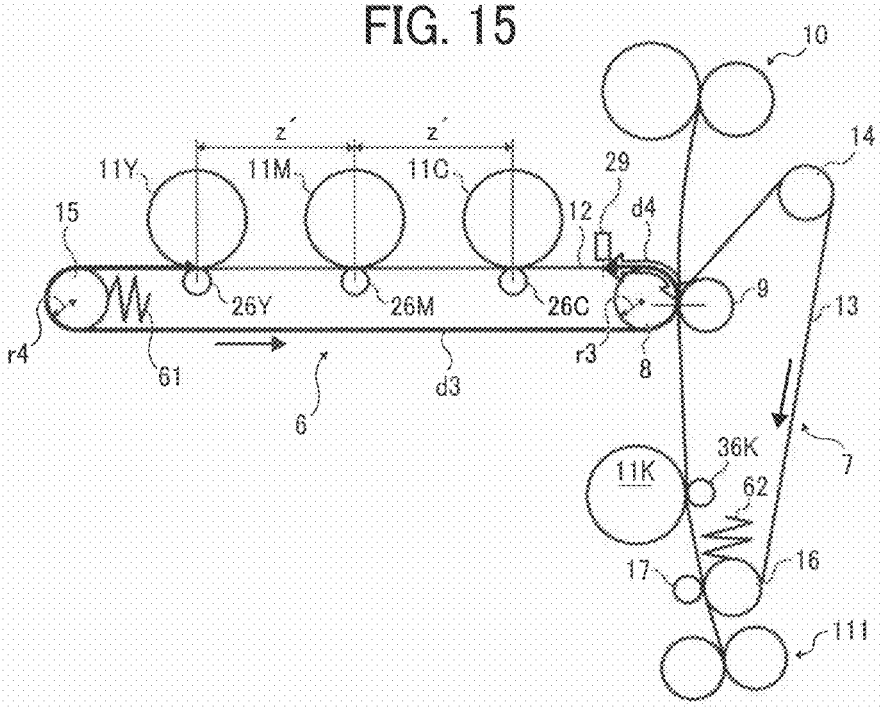
FIG. 15 is a schematic view illustrating a configuration of a transfer section which is a characteristic portion of the third embodiment.

FIG. 15 is a schematic view illustrating a configuration of a transfer section which is a characteristic portion of the embodiment. The intermediate transfer belt 12 is suspended by a driving roller 8, and a tension roller 15, and the direct transfer belt 13 is suspended by a driving roller 14, a secondary transfer roller 9, and a tension roller 16. A sheet adsorption roller 17 which is applied with a predetermined voltage from a power source (not shown) is disposed at the position facing the tension roller 16.

In addition, an optical sensor 29 configured to read an adjustment pattern image is disposed at the downstream of the secondary transfer of the intermediate transfer belt 12.

In FIG. 15, r3 denotes a radius of the driving roller 8 of the intermediate transfer belt 12, and r4 denotes a radius of the tension roller 15 of the intermediate transfer belt. d3 denotes a distance from the primary transfer position to the sensing position of the optical sensor, and d4 denotes a distance from the secondary transfer position of the K image to the sensing position of the optical sensor. With respect to the r3, d3, and d4, the following relationship is satisfied. In addition, the d3 is applied to each of the colors Y, M, and C. Therefore, necessarily, the station pitch z' is also an integer times the circumferential length of the driving roller 8 of the intermediate transfer belt, so that phases of the periodic positional irregularity with a period of one rotation of the driving roller are coincident with each other between the colors.

In the case where the radius of the driving roller 8 which drives the intermediate transfer belt 12 to rotate is denoted by r3, a distance from the primary transfer nip to the sensing position of the optical sensor in the path along the intermediate transfer belt 12 towards the intermediate transfer belt rotation direction downstream is denoted by d3, and a distance from the secondary transfer nip, at which the K image is reversely transferred, to the sensing position of the optical sensor in the path along the intermediate transfer belt 12 towards the intermediate transfer belt rotation direction downstream is denoted by d4, the printer according to the embodiment is configured so as to satisfy the following relationships of Equations 9 and 10. In addition, in Equation 9, n5 is a natural number, and in the embodiment, n5=6. In addition, in Equation 10, n6 is also a natural number, and in the embodiment, n6=1.

$$d3=2\pi r3\cdot n5(n5 \text{ is a natural number}) \quad (9)$$

$$d4=2\pi r3\cdot n6(n6 \text{ is a natural number}) \quad (10)$$

Here, in the rotation speed of the intermediate transfer belt 12, a periodic speed change with a period of one rotation of the driving roller 8 occurs due to the eccentricity, the load change, or the like of the driving roller 8. If the speed change occurs in the rotation speed of the intermediate transfer belt 12 and even if the writing of the K pattern image with respect to the photosensitive element 11K is achieved at an ideal position, and the rotation speed of the photosensitive element 11K and the rotation speed of the direct transfer belt 13 are constant, the expansion or contraction of the K pattern image transferred from the photosensitive element 11K to the intermediate transfer belt 12 occurs according to the phase of the speed change occurring in the rotation speed of the intermediate transfer belt 12 when the K pattern image transferred from the photosensitive element 11K to the direct transfer belt is transferred to the intermediate transfer belt at the secondary transfer nip, as seen from FIG. 16.

Figure 16:
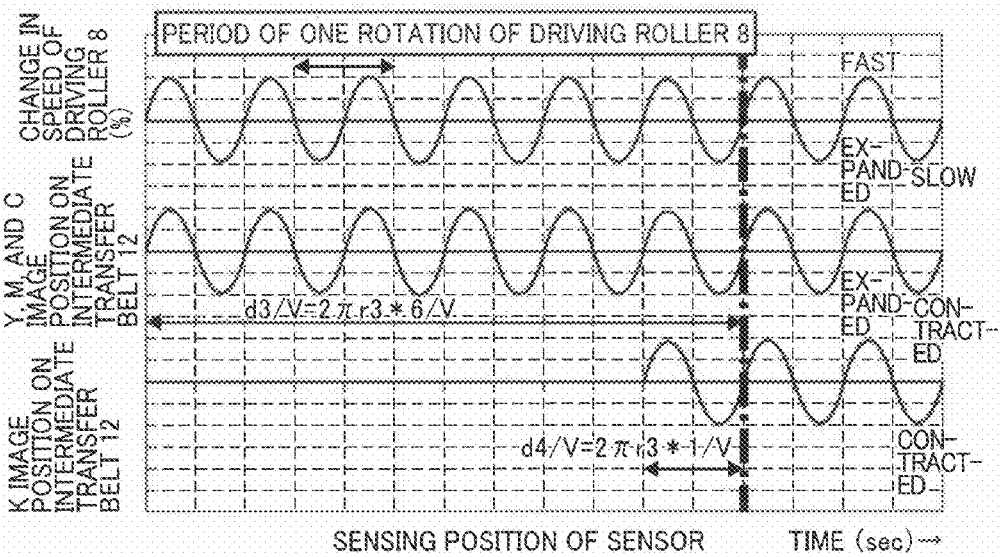
FIG. 16 is a graph illustrating a periodic speed change with a period of one rotation of a driving roller or the like occurring in a rotation speed of an intermediate transfer belt.

Similarly, if the speed change occurs in the rotation speed of the intermediate transfer belt 12 and even if the writing of the Y, M, and C pattern images with respect to the photosensitive elements 11C, 11M, and 11Y is achieved at an ideal position, and the rotation speeds of the photosensitive elements 11C, 11M, and 11Y are constant, the expansion or contraction of the Y, M, and C pattern images transferred to the intermediate transfer belt 12 occurs according to the phase of the speed change occurring in the intermediate transfer belt 12 when the Y, M, and C pattern images are transferred to the intermediate transfer belt 12 at the primary transfer nip, as seen from FIG. 16.

In addition, if the phases of the speed change of the intermediate transfer belt 12 are different between at the secondary transfer nip and at the sensing position, the K pattern image which is transferred at the direct transfer nip from the photosensitive element 11K to the direct transfer belt 13 and which is reversely transferred at the secondary transfer nip on the intermediate transfer belt 12 is erroneously sensed by the optical sensor 29 so that the pattern image is expanded or contracted at the sensing position than when directly transferred.

Similarly, if the phases of the speed change of the intermediate transfer belt 12 are different between at the primary transfer nip and at the sensing position, the Y, M, and C pattern images which are primarily transferred at the primary transfer nip on the intermediate transfer belt 12 are erroneously sensed by the optical sensor 29 so that the pattern images are expanded or contracted at the sensing position than when primarily transferred. Therefore, there is a problem in that accuracy of the correction deteriorates due to the correction performed based on the sensing result which is obtained by the erroneous sensing Therefore, in the embodiment, as expressed by the aforementioned Equation 9, the distance d3 between the primary transfer nip and the sensing position in the intermediate transfer belt rotation direction is configured to be a natural number times the circumferential length of the driving roller 8 which is a roller member causing a speed change in the intermediate transfer belt 12 among a plurality of the roller members by which the intermediate transfer belt 12 is suspended. Since the distance d3 is configured to be a natural times the circumferential length of the driving roller 8, the phases of the periodic speed change of the intermediate transfer belt 12 occurring with a period of one rotation of the driving roller 8 can be aligned between at the primary transfer nip and at the sensing position, as seen from FIG. 16. Therefore, it is possible to cancel out the influences of the periodic speed change occurring with a period of one rotation of the driving roller 8 to the rotation speed of the intermediate transfer belt 12 at the primary transfer nip and at the sensing position. Accordingly, it is possible to prevent the Y, M, and C pattern images which are secondarily transferred at the primary transfer nip to the intermediate transfer belt 12 from being erroneously sensed, due to the periodic speed change of the intermediate transfer belt 12 occurring with a period of one rotation of the driving roller 8, so that the pattern images are expanded or contracted at the sensing position than when primarily transferred.

In addition, as expressed by the aforementioned Equation 10, the distance d4 between the secondary transfer nip and the sensing position in the intermediate transfer belt rotation direction is configured to be a natural number times the circumferential length of the driving roller 8. Since the distance d4 is configured to be a natural number times the circumferential length of the driving roller 8, the phases of the periodic speed change of the intermediate transfer belt 12 occurring with a period of one rotation of the driving roller 8 can be aligned between at the secondary transfer nip and at the sensing position, as seen from FIG. 16. Therefore, it is possible to cancel out the influences of the periodic speed change occurring with a period of one rotation of the driving roller 8 to the rotation speed of the intermediate transfer belt 12 at the secondary transfer nip and at the sensing position. Accordingly, it is possible to prevent the K pattern image which is transferred at the direct transfer nip from the photosensitive element 11K to the direct transfer belt 13 and, after that, reversely transferred at the secondary transfer nip to the intermediate transfer belt 12 from being erroneously sensed, due to the periodic speed change of the intermediate transfer belt 12 occurring with a period of one rotation of the driving roller 8, so that the pattern image is expanded or contracted at the sensing position than when directly transferred.

In this manner, in the embodiment, the phases of the speed change of the periodic rotation speed of the intermediate transfer belt 12 occurring with a period of one rotation of the driving roller 8 are equal to each other between at the primary transfer time and the reverse transfer time and at each pattern image reading time by the optical sensor 29. Therefore, since, in the color matching adjustment, the periodic speed change of the intermediate transfer belt 12 occurring with a period of one rotation of the driving roller 8 can be neglected and thus only the other changes are detected from the pattern images by the optical sensor 29, the color matching adjustment can be performed based on the sensing result, so that the accuracy of the color matching adjustment can be improved.

Furthermore, in the embodiment, the Y, M, and C station pitches z' are configured to satisfy the relationship of Equation 11 so that each color is configured to satisfy the aforementioned Equation 9. In addition, in Equation 11, n7 is a natural number.

$$z'=2\pi r3\cdot n7(n7 \text{ is a natural number}) \quad (11)$$

The transport speed of the intermediate transfer belt 12 has a periodic change with a period of one rotation of the driving roller 8 due to the eccentricity or the like of the driving roller 8 which drives the intermediate transfer belt 12 to rotate. If a target speed of the intermediate transfer belt 12 is denoted by V0, the speed change occurs with a period of (2πr3)/V0. Therefore, in the Y, M, and C toner images primarily transferred from the photosensitive elements 11Y, 11M, and 11C to the intermediate transfer belt 12, periodic image positional irregularity occurs with a period of one rotation of the driving roller 8.

Whereas, in the embodiment, as expressed in Equation 11, since the station pitch z' and the circumferential length (1 rotation pitch) of the driving roller 8 are set to be the same length, the phases in the image are always the same between at the Y, M, and C primary transfer nips. Therefore, it is possible to suppress the occurrence of color irregularity in the Y, M, and C toner images primarily transferred onto the intermediate transfer belt 12. The intermediate transfer belt 12 on which the C, M, and Y toner images are sequentially transferred at the C, M, and Y primary transfer nips is driven to rotate with the periodic speed change with a period of one rotation of the driving roller 8, so that the image on which three colors are superimposed is transported from the Y primary transfer nip to the secondary transfer nip or the pattern sensing position.

In addition, although the periodic speed change with a period of one rotation of the driving roller 8 has a dominant influence on the rotation speed of the intermediate transfer belt 12, there is considered a case where, with a period of one rotation (1 rotation pitch) of each driven roller such as the tension roller 15 and the primary transfer rollers 26Y, 26M, and 26C which are driven to rotate by the rotation of the intermediate transfer belt 12, a periodic speed change occurs in the rotation speed of the intermediate transfer belt 12 due to the load change or the like.

In the case where the radius of the driven roller (the tension roller 15, the primary transfer rollers 26Y, 26M, and 26C) which is driven to rotate by the rotation of the intermediate transfer belt 12 is denoted by r4, the distance from the primary transfer position to the sensing position of the optical sensor 29 in the path along the intermediate transfer belt 12 towards the intermediate transfer belt rotation direction downstream is denoted by d3, and the distance from the secondary transfer nip of reversely transferring the K image to the sensing position of the optical sensor in the path along the intermediate transfer belt 12 towards the intermediate transfer belt rotation direction downstream is denoted by d4, by employing a configuration in which the following relationships of Equations 12 and 13 are satisfied, it is possible to suppress a deterioration in the accuracy of the color matching adjustment occurring with the pitch of the each driven roller.

$$d3=2\pi r4\cdot n8(n8 \text{ is a natural number}) \quad (12)$$

$$d4=2\pi r4\cdot n9(n9 \text{ is a natural number}) \quad (13)$$

In addition, all the configurations satisfying the aforementioned relationships of Equations 9, 10, 11, 12, and 13 have independent geometrical relationships in the intermediate transfer unit. Therefore, although the K image forming unit 1K, in other words, the K direct transfer nip is disposed at the recording sheet transport direction downstream from the secondary transfer nip as illustrated in FIG. 17, the aforementioned various effects can be obtained like the case where the K direct transfer nip is disposed at the recording sheet transport direction upstream from the secondary transfer nip.

In the embodiment, the recording sheet P is mounted and transported by the direct transfer belt 13 so as to pass the direct transfer nip and the secondary transfer nip. Therefore, despite of whether the direct transfer nip is disposed at the recording sheet transport direction upstream or downstream with respect to the secondary transfer nip, the recording sheet P can be allowed to pass the direct transfer nip and the secondary transfer nip by the direct transfer belt 13. Accordingly, deterioration of a degree of freedom in the layout of the inner portion of the image forming apparatus, in which the direct transfer nip is necessarily located at the recording sheet transport direction downstream from the secondary transfer nip and which may occur in a conventional image forming apparatus, does not occur Here, in the printer according to the embodiment, a well-known configuration of recovering remaining transfer toners, which are removed from the surfaces of the photosensitive elements 11Y, 11M, 11C, and 11K by the drum cleaning device, into the developing devices corresponding to the colors and reusing the toners for image formation may be employed.

Figure 17:
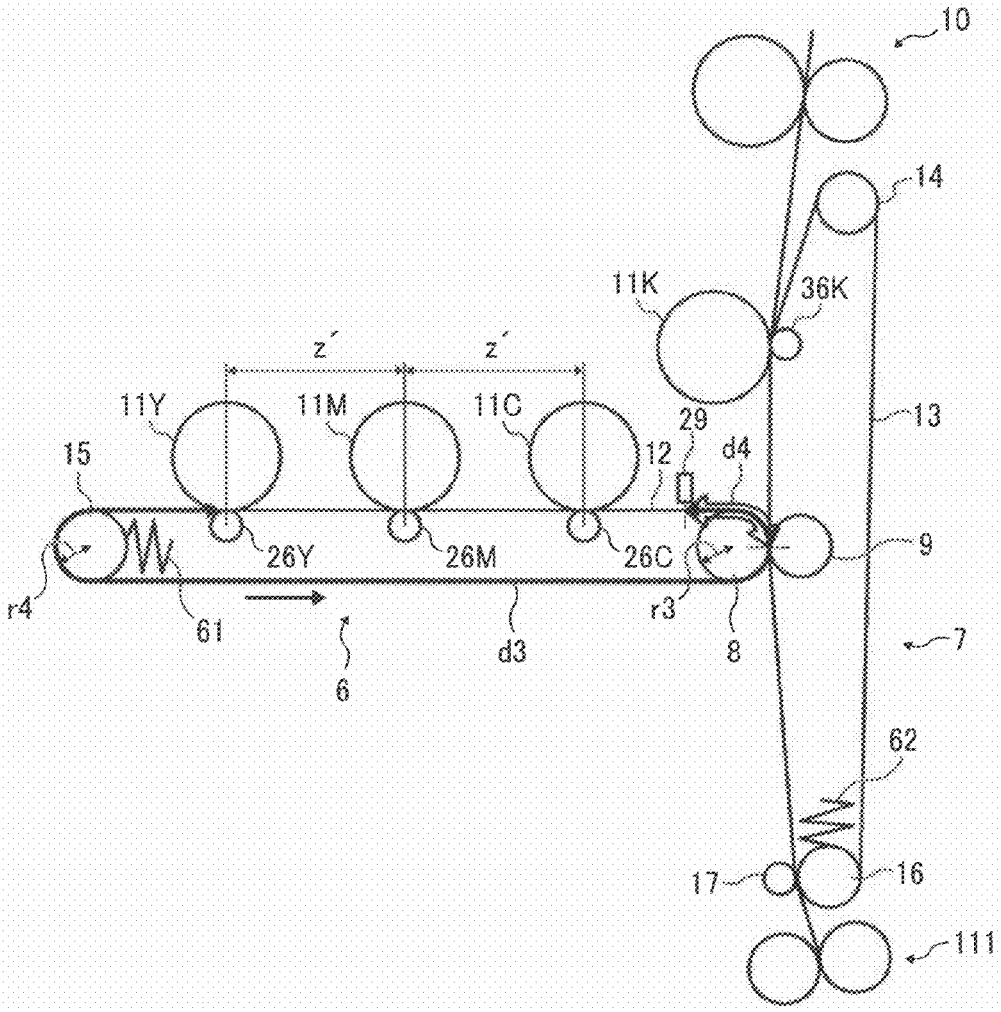
FIG. 17 is a schematic view illustrating a configuration of a transfer section in the case where a K image forming unit is disposed at a downstream of a secondary transfer nip in a recording sheet transport direction.

At this time, if the K image forming unit 1K, in other words, the K direct transfer nip is disposed at the recording sheet transport direction downstream from the secondary transfer nip as illustrated in FIG. 17, the toners of the colors of the Y, M, and C toner images transferred onto the recording sheet P at the secondary transfer nip may be reversely transferred from the recording sheet P to the surface of the photosensitive element 11K at the time of transferring the K toner image at the direct transfer nip. If the toners of the Y, M, and C colors reversely transferred in this manner are removed from the photosensitive element 11K and recovered into the K developing device, a color mixing occurs in the K developing device, so that the color of the image (K toner image) formed by the image forming unit 1K by using the toner is changed according to the time elapse.

On the contrary, by employing a configuration in which the K image forming unit 1K, in other words, the K direct transfer nip is disposed at the recording sheet transport direction upstream from the secondary transfer nip as illustrated in FIG. 12 or the like, the toners of the Y, M, and C colors transferred onto the recording sheet P at the secondary transfer nip cannot be reversely transferred to the surface of the photosensitive element 11K. Therefore, a color mixing does not occur in the K developing device, so that it is possible to prevent the color of the image (K toner image) formed by the image forming unit 1K from being changed according to the time elapse.

Figure 18:
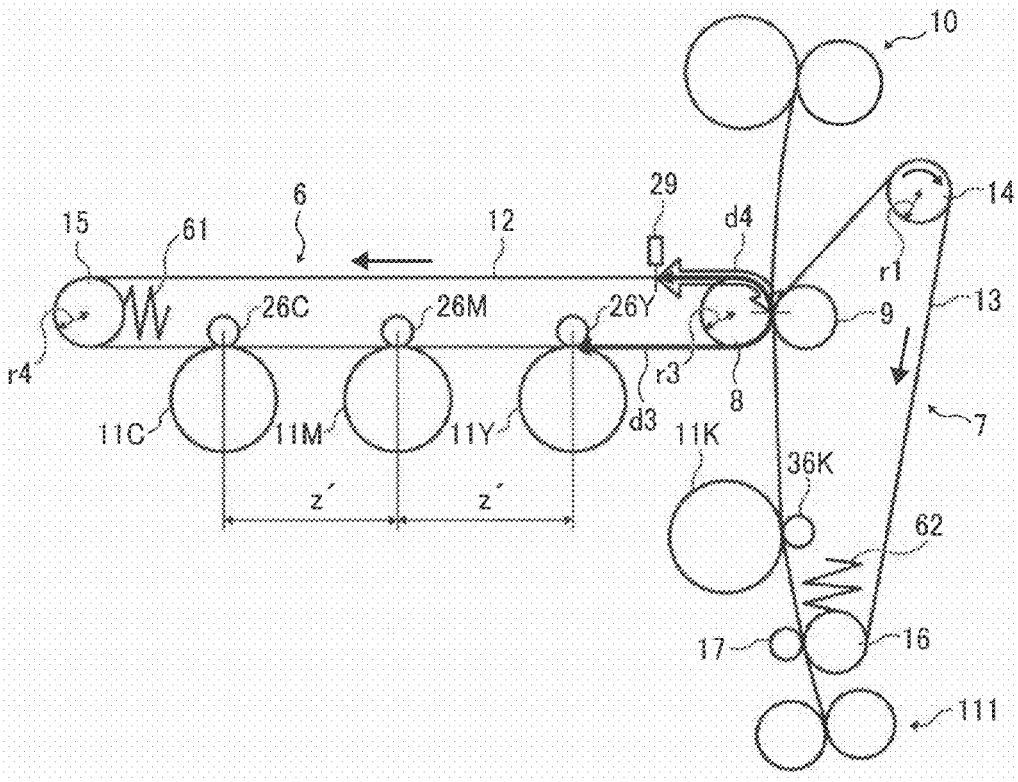
FIG. 18 is a schematic view illustrating a configuration of a transfer section in the case where a photosensitive element is disposed below an intermediate transfer belt.

In addition, in the printer according to the embodiment, although the photosensitive elements 11Y, 11M, and 11C are located above the intermediate transfer belt 12, the photosensitive elements 11Y, 11M, and 11C may be disposed under the intermediate transfer belt 12 as illustrated in FIG. 18.

Figure 19:
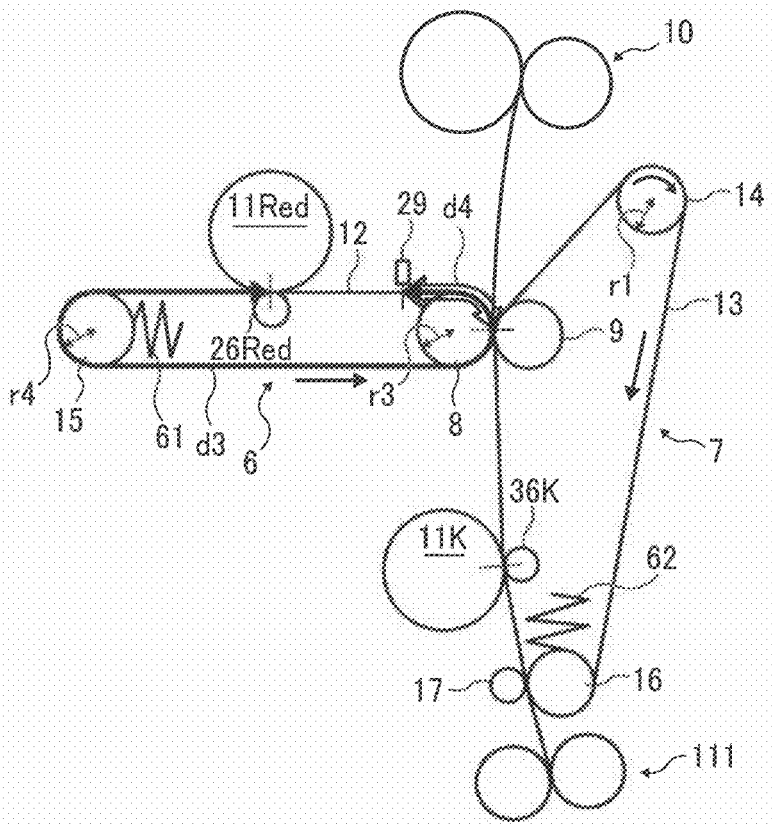
FIG. 19 is a schematic view illustrating a configuration of a transfer section in the case where there is one image forming unit facing an intermediate transfer belt.

In addition, as illustrated in FIG. 19, a single image forming unit 1 (photosensitive element 11) may face the intermediate transfer belt 12. In FIG. 19, the image forming unit 1R forming the toner image by using red toner is disposed to face the intermediate transfer belt 12.

The aforementioned configuration is applied to an image forming apparatus simultaneously using the direct transfer scheme and the indirect transfer scheme, so that accuracy of color matching adjustment is improved. Therefore, it is possible to provide an image forming apparatus capable of forming a high quality image without color irregularity or image irregularity.

As described above, the aforementioned configuration is applied to an image forming apparatus simultaneously using the direct transfer scheme and the indirect transfer scheme, so that accuracy of color matching adjustment is improved. Therefore, it is possible to provide an image forming apparatus capable of forming a high quality image without color irregularity or image irregularity.

Fourth Embodiment

Hereinafter, a fourth embodiment where the present invention is applied to a color laser printer (hereinafter, simply referred to as a printer) which is an electronic photographing type image forming apparatus is described. The basic configuration of the printer according to the embodiment is substantially the same as that of the printer according to the third embodiment, and thus, the description thereof is omitted.

Figure 20:
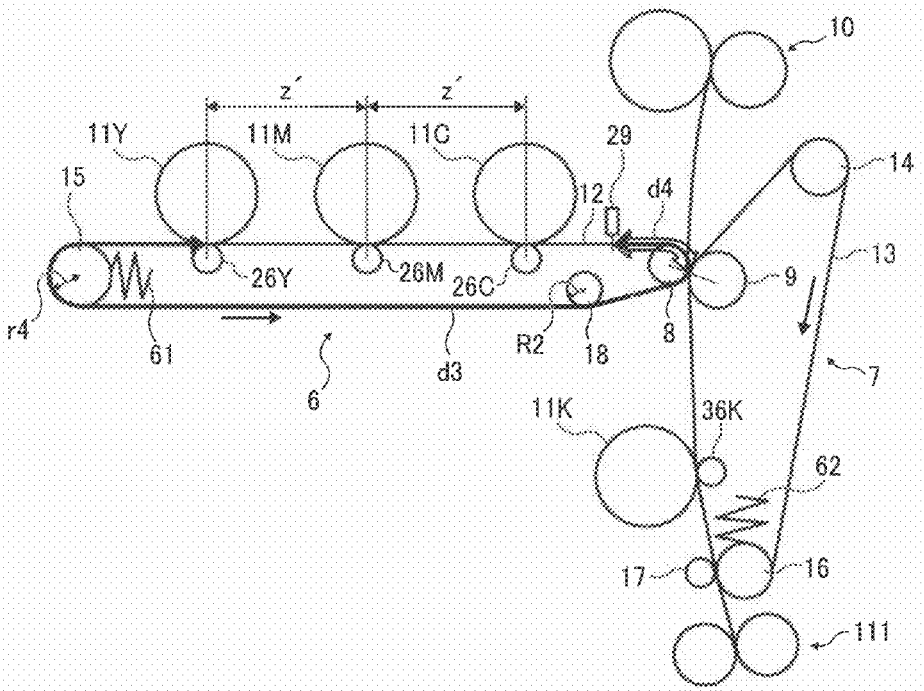
FIG. 20 is a schematic view illustrating a configuration of a transfer section which is a characteristic portion of a fourth embodiment.

FIG. 20 is a schematic view illustrating a configuration of a transfer section which is a characteristic portion of the embodiment.

The intermediate transfer belt 12 is suspended by a driving roller 8, a tension roller 15, a driven roller 18, and the like. An axis of the tension roller 15 is swingably supported and biased by a spring from the inner side to the outer side of the intermediate transfer belt to exert a tension to the intermediate transfer belt 12. The driving roller 8 is driven to rotate by a driving motor (not shown) provided in a printer main body, and the tension roller 15, the driven roller 18, or the like is driven to rotate by the rotation of the intermediate transfer belt 12 which is driven to rotate by the driving roller 8.

An encoder (not shown) that is a detecting unit configured to detect a rotation angle change or a rotation angle speed of the driven roller 18 is disposed coaxially with the driven roller 18. In addition, the encoder may not be disposed coaxially with the driven roller 18, but it may be disposed coaxially with any one of the primary transfer rollers 26Y, 26M, and 26C which are driven by the rotation of the intermediate transfer belt 12 similarly to the driven roller 18. However, since the tension roller 15 that is driven by the rotation of the intermediate transfer belt 12 similarly to the driven roller 18 or the like is swingably supported in the state where the tension roller 15 is biased by a spring, the tension roller 15 is easy to be affected by the load change, and the accuracy of measurement of the rotation angle change or the rotation angle speed of the tension roller 15 by the encoder deteriorates in comparison with the case where the encoder is disposed coaxially with any one of other driven rollers such as the primary transfer rollers 26Y, 26M, and 26C. Therefore, the later-described feedback control may not be appropriately performed, so that it is not preferable that the encoder is disposed coaxially with the tension roller 15.

Figure 21:
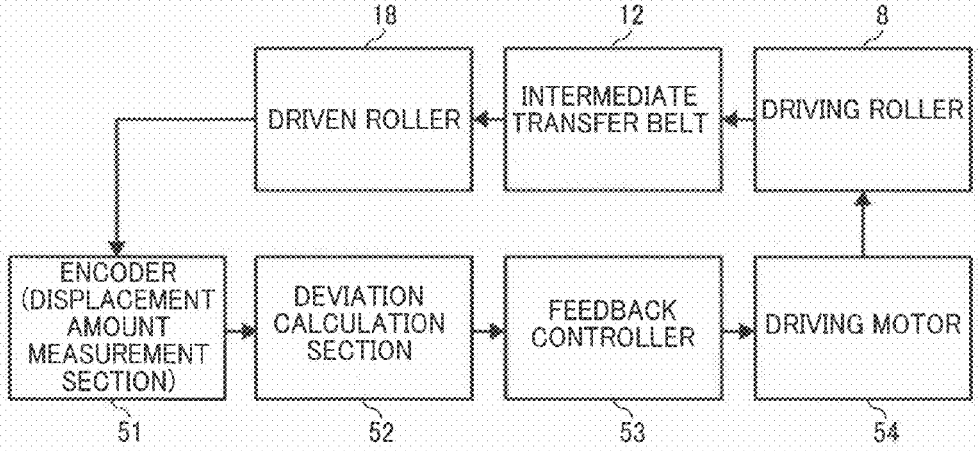
FIG. 21 is a schematic block diagram illustrating an example of a configuration of a rotation driving control device of an intermediate transfer unit.

FIG. 21 is a schematic block diagram illustrating an example of a configuration of the rotation driving control device of the intermediate transfer unit 6.

A feedback controller 53 feeds the sensing result of the rotation angle change or the rotation angle speed of the driven roller 18 which is obtained based on an output from an encoder 51, that is, a displacement amount measuring unit back to the rotation speed of a driving motor 54 which drives the driving roller 8 to rotate. More specifically, when the rotation angle change or the rotation angle speed of the driven roller 18 is smaller than a control target value which is obtained in advance through an experiment or the like, the driving motor 54 is controlled (acceleration-controlled) in a feedback manner by the feedback controller 53 according to a deviation between the rotation angle change or the rotation angle speed sensed by the encoder 51 and the control target value, which is calculated by a deviation calculation section 52, so that the rotation speed of the driving motor 54 is increased, and thus, the rotation speed of the driving roller 8 is increased. On the other hand, when the rotation angle change or the rotation angle speed of the driven roller 18 is larger than the control target value, the driving motor 54 is controlled (deceleration-controlled) in a feedback manner by the feedback controller 53 according to the deviation which is calculated by the deviation calculation section 52, so that the rotation speed of the driving motor 54 is decreased, and thus, the rotation speed of the driving roller 8 is decreased.

In this manner, in the embodiment, the driving roller 8 is controlled in a feedback manner to be driven to rotate based on the detection signal from the encoder 51 provided coaxially with the driven roller 18 so that the rotation angle change or the rotation angle speed of the driven roller 18 is maintained to be constant. By the feedback control, it is possible to suppress the periodic speed change with a period of one rotation of the driving roller 8 or the like occurring in the intermediate transfer belt 12 due to the eccentricity or the like of the driving roller 8, so that it is possible to stabilize the rotation speed of the intermediate transfer belt 12 which is rotated by the driving roller 8.

Next, the direct transfer belt 13 is suspended by a secondary transfer roller 9, a driving roller 14, a tension roller 16, and the like. An axis of the tension roller 16 is swingably supported and biased by the spring from the inner side to the outer side of the direct transfer belt to exert a tension to the direct transfer belt 13. The driving roller 14 is driven to rotate by a driving motor (not shown) provided in a printer main body, and the secondary transfer roller 9 and the tension roller 16 are driven to rotate by the rotation of the direct transfer belt 13 which is driven to rotate by the driving roller 14. In addition, a sheet adsorption roller 17 which is applied with a predetermined voltage from a power source (not shown) and allows the recording sheet P to be adsorbed on the direct transfer belt 13 by an electrostatic force is disposed at the position of facing the tension roller 16 through the direct transfer belt 13. The sheet adsorption roller 17 is in contact with the front surface (outer surface of the loop) of the direct transfer belt 13, and the sheet adsorption roller 17 is also driven to rotate by the rotation of the direct transfer belt 13.

An encoder (not shown) that is a detecting unit configured to detect a rotation angle change or a rotation angle speed of the secondary transfer roller 9 is disposed coaxially with the secondary transfer roller 9 that is a driven roller which is driven by the rotation of the direct transfer belt 13. The encoder may not be disposed coaxially with the secondary transfer roller 9, but it may be disposed coaxially with the transfer roller 36K that is a driven roller similarly to the secondary transfer roller 9. Otherwise, a new driven roller which is driven by the rotation of the direct transfer belt 13 is disposed, and the encoder may be disposed coaxially with the driven roller. However, since the tension roller 16 that is driven by the rotation of the direct transfer belt 13 similarly to the secondary transfer roller 9 or the like is swingably supported in the state where the tension roller 16 is biased by the spring, the tension roller 16 is easy to be affected by the load change, and the accuracy of measurement of the rotation angle change or the rotation angle speed of the tension roller 16 by the encoder deteriorates in comparison with the case where the encoder is disposed coaxially with any one of other driven rollers such as the transfer roller 36K. Therefore, the later-described feedback control may not be appropriately performed, so that it is not preferable that the encoder is disposed coaxially with the tension roller 16.

Figure 22:
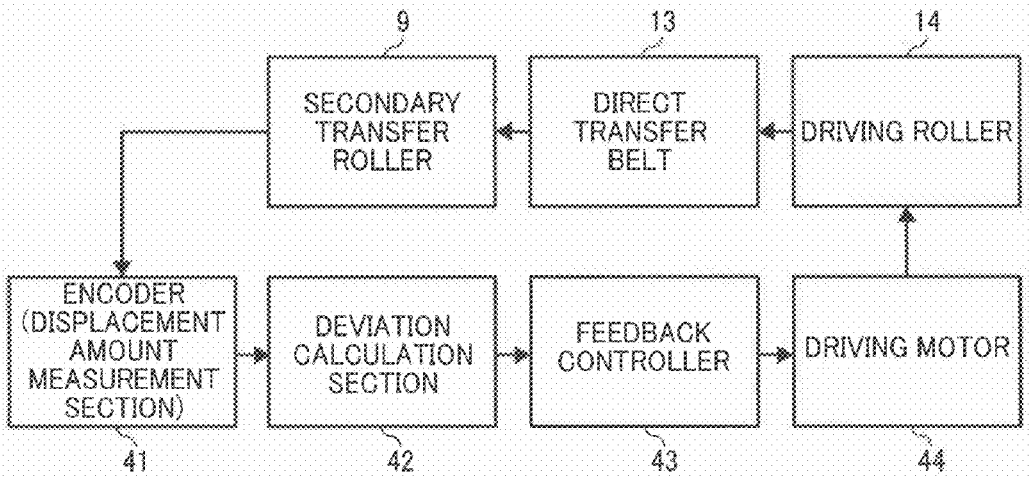
FIG. 22 is a schematic block diagram illustrating an example of a configuration of a rotation driving control device of a direct transfer unit.

FIG. 22 is a schematic block diagram illustrating an example of a configuration of the rotation driving control device of the direct transfer unit 7.

A feedback controller 43 feeds the sensing result of the rotation angle change or the rotation angle speed of the secondary transfer roller 9 which is obtained based on an output from an encoder 41 that is a displacement amount measuring unit back to the rotation speed of a driving motor 44 which drives the driving roller 14 to rotate. More specifically, when the rotation angle change or the rotation angle speed of the secondary transfer roller 9 is smaller than a control target value which is obtained in advance through an experiment or the like, the driving motor 44 is controlled (acceleration-controlled) in a feedback manner by the feedback controller 43 according to a deviation between the rotation angle change or the rotation angle speed sensed by the encoder 41 and the control target value, which is calculated by a deviation calculation section 42, so that the rotation speed of the driving motor 44 is increased, and thus, the rotation speed of the driving roller 14 is increased. On the other hand, when the rotation angle change or the rotation angle speed of the secondary transfer roller 9 is larger than the control target value, the driving motor 44 is controlled (deceleration-controlled) in a feedback manner by the feedback controller 43 according to the deviation which is calculated by the deviation calculation section 42, so that the rotation speed of the driving motor 44 is decreased, and thus, the rotation speed of the driving roller 14 is decreased.

In this manner, in the embodiment, the driving roller 14 is controlled in a feedback manner to be driven to rotate based on the detection signal from the encoder 41 provided coaxially with the secondary transfer roller 9 so that the rotation angle change or the rotation angle speed of the secondary transfer roller 9 is maintained to be constant. By the feedback control, it is possible to suppress the periodic speed change with a period of one rotation of the driving roller 14 or the like occurring in the direct transfer belt 13 due to the eccentricity or the like of the driving roller 14, so that it is possible to stabilize the rotation speed of the direct transfer belt 13 which is rotated by the driving roller 8.

However, in the control, although the periodic speed change with a period of one rotation of the driving roller 8 occurring in the intermediate transfer belt 12 is suppressed by the feedback control, the periodic speed change with a period of one rotation of the driven roller 18 occurring in the intermediate transfer belt 12 due to the eccentricity or the like of the driven roller 18 provided with the encoder is not suppressed by the feedback control. In other words, if there is an eccentricity in the driven roller 18 provided with the encoder, the speed change component caused by the eccentricity of the driven roller is fed back to the rotation speed of the driving roller 8 and thus to the rotation speed of the driving motor, so that a speed change caused by the eccentricity of the driven roller occurs in the intermediate transfer belt 12. Therefore, the rotation speed of the intermediate transfer belt 12 has a periodic speed change with a period of one rotation of the driven roller 18. If a target speed of the intermediate transfer belt 12 is denoted by V0, the speed change occurs by the period of $(2\pi r2)/V0$.

In the case where a radius of the driven roller 18 which is driven by the rotation of the intermediate transfer belt 12 and which is a driven roller coaxially provided with the encoder is denoted by R2, a distance from the primary transfer nip to the sensing position of the optical sensor in the path along the intermediate transfer belt 12 towards the intermediate transfer belt rotation direction downstream is denoted by d3, and a distance from the secondary transfer nip, at which the K image is reversely transferred, to the sensing position of the optical sensor in the path along the intermediate transfer belt 12 towards the intermediate transfer belt rotation direction downstream is denoted by d4, the printer according to the embodiment is configured so as to satisfy the following relationships of Equations 14 and 15. In addition, in Equation 14, N3 is a natural number, and in the embodiment, N3=6. In addition, In Equation 15, N4 is also a natural number, and in the embodiment, N4=1.

$$d3=2\pi R2\cdot N3(N3 \text{ is a natural number}) \quad (14)$$

$$d4=2\pi R2\cdot N4(N4 \text{ is a natural number}) \quad (15)$$

Herein, in the rotation speed of the intermediate transfer belt 12, a periodic speed change with a period of one rotation of the driven roller 18 occurs due to the eccentricity, the load change, or the like of the driven roller 18. If the speed change occurs in the rotation speed of the intermediate transfer belt 12 and even if the writing of the K pattern image with respect to the photosensitive element 11K is an ideal position, and the rotation speed of the photosensitive element 11K and the rotation speed of the direct transfer belt 13 are constant, the expansion or contraction of the K pattern image transferred from the photosensitive element 11K to the intermediate transfer belt 12 occurs according to the phase of the speed change occurring in the rotation speed of the intermediate transfer belt 12 when the K pattern image transferred from the photosensitive element 11K to the direct transfer belt is transferred to the intermediate transfer belt at the secondary transfer nip.

Similarly, if the periodic speed change with a period of one rotation of the driven roller 18 occurs in the rotation speed of the intermediate transfer belt 12 and even if the writing of the Y, M, and C pattern images with respect to the photosensitive elements 11C, 11M, and 11Y is achieved at an ideal position, and the rotation speeds of the photosensitive elements 11C, 11M, and 11Y are constant, the expansion or contraction of the Y, M, and C pattern images transferred from the photosensitive elements 11Y, 11M, and 11C to the intermediate transfer belt 12 occurs according to the phase of the speed change occurring in the intermediate transfer belt 12 when the Y, M, and C pattern images are transferred from the photosensitive elements 11Y, 11M, and 11C to the intermediate transfer belt 12 at the primary transfer nip.

In addition, if the phases of the speed change of the intermediate transfer belt 12 are different between at the secondary transfer nip and at the sensing position, the K pattern image which is transferred at the direct transfer nip from the photosensitive element 11K to the direct transfer belt 13 and, after that, reversely transferred at the secondary transfer nip to the intermediate transfer belt 12 is erroneously sensed by the optical sensor 29 so that the pattern image is expanded or contracted at the sensing position than when directly transferred. Similarly, if the phases of the speed change of the intermediate transfer belt 12 are different between at the primary transfer nip and at the sensing position, the Y, M, and C pattern images which are primarily transferred from the photosensitive elements 11Y, 11M, and 11C to the intermediate transfer belt 12 at the primary transfer nips are erroneously sensed by the optical sensor 29 so that the pattern images are expanded or contracted at the sensing position than when primarily transferred. Therefore, there is a problem in that accuracy of the correction deteriorates due to the correction performed based on the sensing result which is obtained by the erroneous sensing Therefore, in the embodiment, as expressed by the aforementioned Equation 14, the distance d3 between the primary transfer nip and the sensing position in the intermediate transfer belt rotation direction is configured to be a natural number times the circumferential length of the driven roller 18 which is a roller member causing a speed change in the intermediate transfer belt 12 among a plurality of the roller members by which the intermediate transfer belt 12 is suspended and which is driven to rotate by the rotation of the intermediate transfer belt 12. Since the distance d3 is configured to be a natural times the circumferential length of the driven roller 18, the phases of the periodic speed change of the intermediate transfer belt 12 occurring with a period of one rotation of the driving roller 8 can be aligned between at the primary transfer nip and at the sensing position. Therefore, it is possible to cancel out the influences of the periodic speed change occurring with a period of one rotation of the driven roller 18 to the rotation speed of the intermediate transfer belt 12 at the primary transfer nip and at the sensing position. Accordingly, it is possible to prevent the Y, M, and C pattern images which are secondarily transferred at the primary transfer nip from the photosensitive elements 11Y, 11M, and 11C to the intermediate transfer belt 12 from being erroneously sensed, due to the periodic speed change of the intermediate transfer belt 12 occurring with a period of one rotation of the driven roller 18, so that the pattern images are expanded or contracted at the sensing position than when primarily transferred.

In addition, as expressed by the aforementioned Equation 15, the distance d4 between the secondary transfer nip and the sensing position in the intermediate transfer belt rotation direction is configured to be a natural number times the circumferential length of the driven roller 18. Since the distance d4 is configured to be a natural number times the circumferential length of the driven roller 18, the phases of the periodic speed change of the intermediate transfer belt 12 occurring with a period of one rotation of the driven roller 18 can be aligned between at the secondary transfer nip and at the sensing position. Therefore, it is possible to cancel out the influences of the periodic speed change occurring with a period of one rotation of the driven roller 18 to the rotation speed of the intermediate transfer belt 12 at the secondary transfer nip and at the sensing position. Accordingly, it is possible to prevent the K pattern image which is transferred at the direct transfer nip from the photosensitive element 11K to the direct transfer belt 13 and, after that, reversely transferred at the secondary transfer nip to the intermediate transfer belt 12 from being erroneously sensed, due to the periodic speed change of the intermediate transfer belt 12 occurring with a period of one rotation of the driven roller 18, so that the pattern image is expanded or contracted at the sensing position than when directly transferred.

In this manner, in the embodiment, the phases of the periodic speed change of the rotation speed of the intermediate transfer belt 12 occurring with a period of one rotation of the driven roller 18 are equal to each other between at the primary transfer time and the reverse transfer time and at each pattern image reading time by the optical sensor 29. Therefore, in the color matching adjustment, the periodic speed change of the intermediate transfer belt 12 occurring with a period of one rotation of the driven roller 18 can be neglected and thus only the other changes are detected from the pattern images by the optical sensor 29, and the color matching adjustment can be performed based on the sensing result, resulting in that the accuracy of the color matching adjustment can be improved.

Furthermore, in the embodiment, the Y, M, and C station pitches z' are configured to satisfy the relationship of Equation 16 so that each color is configured to satisfy the aforementioned Equation 14. In addition, in Equation 16, N5 is a natural number.

$$z' = 2\pi R2 \cdot N5 (N5 \text{ is a natural number}) \quad (16)$$

The transport speed of the intermediate transfer belt 12 has a periodic change with a period of one rotation of the driven roller 18 due to the eccentricity or the like of the driven roller 18 which drives the intermediate transfer belt 12 to rotate. If a target speed of the intermediate transfer belt 12 is denoted by V0, the speed change occurs by a period of (2πR2)/V0. Therefore, in the Y, M, and C toner images primarily transferred from the photosensitive elements 11Y, 11M, and 11C to the intermediate transfer belt 12, periodic image positional irregularity occurs with a period of one rotation of the driven roller 18.

Whereas, in the embodiment, as expressed in Equation 16, since the station pitch z' is set to be a natural number times the circumferential length (1 rotation pitch) of the driven roller 18, the phases in the image are always the same between at the Y, M, and C primary transfer nips. Therefore, it is possible to suppress the occurrence of color irregularity in the Y, M, and C toner images primarily transferred onto the intermediate transfer belt 12. The intermediate transfer belt 12 on which the C, M, and Y toner images are sequentially transferred at the C, M, and Y primary transfer nips is driven to rotate with the periodic speed change with a period of one rotation of the driving roller 8, so that the image on which three colors are superimposed is transported from the Y primary transfer nip to the secondary transfer nip or the pattern sensing position.

In addition, all the configurations satisfying the aforementioned relationships of Equations 14, 15, and 16 have independent geometrical relationships in the intermediate transfer unit 6 or the direct transfer unit 7. Therefore, even if the K image forming unit 1K, in other words, the K direct transfer nip is disposed at the recording sheet transport direction downstream from secondary transfer nip, since, in the color matching adjustment, the periodic speed change of the intermediate transfer belt 12 with a period of one rotation of the driven roller 18 can be neglected, and thus the color matching adjustment can be performed by sensing the other changes as described above, the accuracy can be improved.

In the embodiment, the recording sheet P is mounted and transported by the intermediate transfer belt 12 so as to pass the direct transfer nip and the secondary transfer nip. Therefore, despite of whether the direct transfer nip is disposed at the recording sheet transport direction upstream or downstream with respect to the secondary transfer nip, the recording sheet P can be allowed to pass the direct transfer nip and the secondary transfer nip by the intermediate transfer belt 12. Accordingly, deterioration of a degree of freedom in the layout of the inner portion of the image forming apparatus, in which the direct transfer nip is necessarily located at the recording sheet transport direction downstream from the secondary transfer nip and which may occur in a conventional image forming apparatus, does not occur.

In addition, in the printer according to the embodiment, a well-known configuration of recovering remaining transfer toners, which are removed from the surfaces of the photosensitive elements 11Y, 11M, 11C, and 11K by the drum cleaning device, into the developing devices corresponding to the colors and reusing the toners for image formation may also be employed. At this time, due to the same reason as that described in the third embodiment, in the embodiment, by employing a configuration in which the K image forming unit 1K, in other words, the K direct transfer nip is disposed at the recording sheet transport direction upstream from the secondary transfer nip, a color mixing does not occur in the K developing device, so that it is possible to prevent the color of the image (K toner image) formed by the image forming unit 1K from being changed according to the time elapse.

In addition, in the printer according to the embodiment, although the photosensitive elements 11Y, 11M, and 11C are located above the intermediate transfer belt 12, the photosensitive elements 11Y, 11M, and 11C may be disposed under the intermediate transfer belt 12.

In addition, a single image forming unit 1 (photosensitive element 11) may be disposed to face the intermediate transfer belt 12.

As described above, the aforementioned configuration is applied to an image forming apparatus simultaneously using the direct transfer scheme and the indirect transfer scheme, so that it is possible to provide an image forming apparatus capable of forming a high quality image without color irregularity, image irregularity, and image expansion or contraction.

As described above, according to the first and second embodiments, there is provided an image forming apparatus including: a first image carrier; a first image forming unit which forms an image on the first image carrier; the intermediate transfer belt 12 which is an intermediate transfer body to which the image formed on the first image carrier is primarily transferred; the primary transfer roller 26 which is a primary transfer unit which primarily transfers the image from the first image carrier to the intermediate transfer belt 12; the secondary transfer roller 9 which is a secondary transfer unit which secondarily transfers the image transferred to the intermediate transfer belt 12 to the recording sheet P which is a recording medium; a second image carrier which is disposed at a recording sheet transport direction upstream or downstream from a secondary transfer nip which is a secondary transfer position where the image is secondarily transferred from the intermediate transfer belt 12 to the recording sheet P; a second image forming unit which forms an image on the second image carrier; the transfer roller 36 which is a direct transfer unit which directly transfers the image formed on the second image carrier to the recording sheet P; and the direct transfer belt 13 which is a recording medium transport belt which is rotatably suspended by a plurality of roller members to transport the recording sheet P mounted thereon so as to pass a direct transfer nip, which is a direct transfer position where the image is directly transferred from the second image carrier to the recording sheet P, and the secondary transfer nip, wherein the image forming apparatus further includes the optical sensor 19 which is a pattern image sensing unit, which is disposed to face a front surface of the direct transfer belt 13 and which senses the pattern image transferred to the direct transfer belt 13 after formed on the first image carrier and the second image carrier, and wherein a distance between the secondary transfer nip and the sensing position of the pattern images by the optical sensor 19 in the direct transfer belt rotation direction and a distance between the direct transfer nip and the sensing position in the direct transfer belt rotation direction are a natural number times a circumferential length of a roller member causing the speed change in the direct transfer belt 13 among the plurality of roller members by which the direct transfer belt 13 is suspended.

By employing a configuration in which the distance between the secondary transfer nip and the sensing position is a natural number times the circumferential length of the roller member causing the speed change, the phases of the periodic speed change of the direct transfer belt 13 which occurs with a period of one rotation of the roller member causing the speed change can be aligned between at the secondary transfer nip and at the sensing position. Therefore, it is possible to cancel out the influences of the periodic speed change occurring with a period of one rotation of the roller member causing the speed change to the rotation speed of the direct transfer belt 13 at the secondary transfer nip and at the sensing position. Accordingly, it is possible to prevent the pattern image which is secondarily transferred at the secondary transfer nip from the intermediate transfer belt 12 to the direct transfer belt 13 from being erroneously sensed, due to the periodic speed change of the direct transfer belt 13 occurring with a period of one rotation of the roller member causing the speed change, so that the pattern image is expanded or contracted at the sensing position than when secondarily transferred.

In addition, by employing a configuration in which the distance between the direct transfer nip and the sensing position is a natural number times the circumferential length of the roller member causing the speed change, the phases of the periodic speed change of the direct transfer belt 13 which occurs with a period of one rotation of the roller member causing the speed change can be aligned between at the direct transfer nip and at the sensing position. Therefore, it is possible to cancel out the influences of the periodic speed change occurring with a period of one rotation of the roller member causing the speed change to the rotation speed of the direct transfer belt 13 at the direct transfer nip and at the sensing position. Accordingly, it is possible to prevent the pattern image which is directly transferred at the direct transfer nip from the photosensitive element 11K which is the second image carrier to the direct transfer belt 13 from being erroneously sensed, due to the periodic speed change of the direct transfer belt 13 occurring with a period of one rotation of the roller member causing the speed change, so that the pattern image is expanded or contracted at the sensing position than when directly transferred. Therefore, the periodic speed change of the direct transfer belt 13 occurring with a period of one rotation of the roller member can be neglected and thus only the other changes are detected from the pattern images by the optical sensor 19, and the color matching adjustment can be performed based on the sensing result, resulting in that the accuracy of the color matching adjustment can be improved.

In addition, according to the first embodiment, in the case where a radius of the driving roller 14 which drives to rotate the direct transfer belt 13 and is one of roller members by which the direct transfer belt 13 is suspended is denoted by r1 and the distance between the secondary transfer nip and the sensing position in the direct transfer belt rotation direction is denoted by d1, a relationship of $d1=2\pi r1 \cdot n1$ (n1 is a natural number) is satisfied, so that the phases of the periodic speed change of the direct transfer belt 13 occurring with a period of one rotation of the driving roller 14 can be aligned between at the secondary transfer nip and at the sensing position. Therefore, it is possible to cancel out the influences of the periodic speed change occurring with a period of one rotation of the driving roller 14 to the rotation speed of the direct transfer belt 13 at the secondary transfer nip and at the sensing position. Accordingly, it is possible to prevent the Y, M, and C pattern images which are secondarily transferred at the secondary transfer nip from the intermediate transfer belt 12 to the direct transfer belt 13 from being erroneously sensed, due to the periodic speed change of the direct transfer belt 13 occurring with a period of one rotation of the driving roller 14, so that the pattern images are expanded or contracted at the sensing position than when secondarily transferred.

In addition, according to the first embodiment, in the case where a radius of the driving roller 14 which drives to rotate the direct transfer belt 13 and is one of the roller members by which the direct transfer belt 13 is suspended is denoted by r1 and the distance between the direct transfer nip and the sensing position in the direct transfer belt rotation direction is denoted by d2, a relationship of $d2=2\pi r1 \cdot n2$ (n2 is a natural number) is satisfied, so that the phases of the periodic speed change of the direct transfer belt 13 occurring with a period of one rotation of the driving roller 14 can be aligned between at the direct transfer nip and at the sensing position. Therefore, it is possible to cancel out the influences of the periodic speed change occurring with a period of one rotation of the driving roller 14 to the rotation speed of the direct transfer belt 13 at the direct transfer nip and at the sensing position. Accordingly, it is possible to prevent the K pattern image which is directly transferred at the direct transfer nip from the photosensitive element 11K to the direct transfer belt 13 from being erroneously sensed, due to the periodic speed change of the direct transfer belt 13 occurring with a period of one rotation of the driving roller 14, so that the pattern image is expanded or contracted at the sensing position than when directly transferred.

In addition, according to the first embodiment, in the case where a radius of a driven roller which is driven to rotate by the rotation of the direct transfer belt 13 among the plurality of roller members by which the direct transfer belt 13 is suspended is denoted by r2, the distance between the secondary transfer nip and the sensing position in the direct transfer belt rotation direction is denoted by d1, and the distance between the direct transfer nip and the sensing position in the direct transfer belt rotation direction is denoted by d2, a relationship of $d1=2\pi r2 \cdot n3$ (n3 is a natural number) and a relationship of $d2=2\pi r2 \cdot n4$ (n4 is a natural number) are satisfied, so that it is possible to suppress a deterioration in the accuracy of the color matching adjustment occurring with each driven roller pitch.

In addition, according to the second embodiment, the image forming apparatus includes: the driving roller 14 which drives to rotate the direct transfer belt 13 and is one of the roller members by which the direct transfer belt 13 is suspended; the secondary transfer roller 9 which is a driven roller which is driven to rotate by the rotation of the direct transfer belt and is one of the roller members by which the direct transfer belt 13 is suspended; a recording medium transport belt speed detecting unit which is disposed at the secondary transfer roller 9 to detect a rotation speed of the direct transfer belt 13; and a feedback control unit which controls the rotation driving of the driving roller 14 in a feedback manner by using a detection result detected by the recording medium transport belt speed detecting unit, wherein, in the case where a radius of the secondary transfer roller 9 is denoted by R1, the distance between the secondary transfer nip and the sensing position in the direct transfer belt rotation direction is denoted by d1, and the distance between the direct transfer nip and the sensing position in the direct transfer belt rotation direction is denoted by d2, a relationship of $d1=2\pi R1 \cdot N1$ (N1 is a natural number) and a relationship of $d2=2\pi R1 \cdot N2$ (N2 is a natural number) are satisfied. Since the distance d1 is configured to be a natural times the circumferential length of the secondary transfer roller 9, the phases of the periodic speed change of the direct transfer belt 13 occurring with a period of one rotation of the secondary transfer roller 9 can be aligned between at the secondary transfer nip and at the sensing position. Therefore, it is possible to cancel out the influences of the periodic speed change occurring with a period of one rotation of the secondary transfer roller 9 to the rotation speed of the direct transfer belt 13 at the secondary transfer nip and at the sensing position. Accordingly, it is possible to prevent the Y, M, and C pattern images which are secondarily transferred at the secondary transfer nip from the intermediate transfer belt 12 to the direct transfer belt 13 from being erroneously sensed, due to the periodic speed change of the direct transfer belt 13 occurring with a period of one rotation of the secondary transfer roller 9, so that the pattern images are expanded or contracted at the sensing position than when secondarily transferred. In addition, the distance d2 is configured to be a natural times the circumferential length of the secondary transfer roller 9, so that the phases of the periodic speed change of the direct transfer belt 13 occurring with a period of one rotation of the secondary transfer roller 9 can be aligned between at the direct transfer nip and at the sensing position. Therefore, it is possible to cancel out the influences of the periodic speed change occurring with a period of one rotation of the secondary transfer roller 9 to the rotation speed of the direct transfer belt 13 at the direct transfer nip and at the sensing position. Accordingly, it is possible to prevent the K pattern image which is directly transferred at the direct transfer nip from the photosensitive element 11K to the direct transfer belt 13 from being erroneously sensed, due to the periodic speed change of the direct transfer belt 13 occurring with a period of one rotation of the secondary transfer roller 9, so that the pattern images are expanded or contracted at the sensing position than when directly transferred.

In addition, according to the second embodiment, the recording medium transport belt speed detecting unit may include a rotary encoder which is disposed coaxially with the secondary transfer roller 9 to measure a rotation angle speed or a rotation angle change of the secondary transfer roller 9.

In addition, according to the first and second embodiments, by employing a configuration in which a plurality of the optical sensors 19 are provided in a direction perpendicular to the direct transfer belt rotation direction, a difference between left and right sides in the image sub-scan direction can be sensed to perform the color matching adjustment.

In addition, according to the first and second embodiments, by employing a configuration in which the adjustment image is formed with a horizontal pattern image perpendicular to the direct transfer belt rotation direction and a slant pattern image intersecting the direct transfer belt rotation direction at 45 degrees so as to perform color matching adjustment between the images formed by a plurality of the image carriers, the color matching adjustment can be performed by sensing the color irregularity of the image in the main scan direction and the sub-scan direction by the optical sensor 19.

In addition, according to the third and fourth embodiments, there is provided an image forming apparatus including: a first image carrier; a first image forming unit which forms an image on the first image carrier; the intermediate transfer belt 12 to which the image formed on the first image carrier is primarily transferred and which is rotatably suspended by a plurality of roller members; the primary transfer roller 26 which is a primary transfer unit which primarily transfers the image from the first image carrier to the intermediate transfer belt; the secondary transfer roller 9 which is a secondary transfer unit which secondarily transfers the image transferred to the intermediate transfer belt 12 to the recording sheet P which is a recording medium; a second image carrier which is disposed at a recording sheet transport direction upstream or downstream from a secondary transfer nip which is a secondary transfer position where the image is secondarily transferred from the intermediate transfer belt 12 to the recording sheet P; a second image forming unit which forms an image on the second image carrier; the transfer roller 36 which is a direct transfer unit which directly transfers the image formed on the second image carrier to the recording sheet P; and the direct transfer belt 13 which is a recording medium transport belt which is rotatably suspended by a plurality of roller members to transport the recording sheet P mounted thereon so as to pass a direct transfer nip, which is a direct transfer position where the image is directly transferred from the second image carrier to the recording sheet P, and the secondary transfer nip, wherein the image forming apparatus further includes the optical sensor 29 which is a pattern image sensing unit which is disposed to face a front surface of the intermediate transfer belt 12 and which senses the pattern image transferred to the intermediate transfer belt 12 after formed on the first image carrier and the second image carrier, and wherein a distance between the primary transfer nip and the sensing position of the pattern image by the optical sensor 29 in the intermediate transfer belt rotation direction and a distance between the secondary transfer nip and the sensing position in the intermediate transfer belt rotation direction are a natural number times a circumferential length of a roller member causing the speed change in the intermediate transfer belt 12 among the plurality of roller members by which the intermediate transfer belt 12 is suspended.

The distance between the primary transfer nip and the sensing position is configured to be a natural number times the circumferential length of the roller member causing the speed change, so that the phases of the periodic speed change of the intermediate transfer belt 12 occurring with a period of one rotation of the roller member causing the speed change can be aligned between at the primary transfer nip and at the sensing position. Therefore, it is possible to cancel out the influences of the periodic speed change occurring with a period of one rotation of the roller member causing the speed change to the rotation speed of the intermediate transfer belt 12 at the primary transfer nip and at the sensing position. Accordingly, it is possible to prevent the pattern image which is secondarily transferred at the primary transfer nip from the first image carrier to the intermediate transfer belt 12 from being erroneously sensed, due to the periodic speed change of the intermediate transfer belt 12 occurring with a period of one rotation of the roller member causing the speed change, so that the pattern image is expanded or contracted at the sensing position than when primarily transferred.

In addition, the distance between the secondary transfer nip and the sensing position is configured to be a natural number times the circumferential length of the roller member causing the speed change, so that the phases of the periodic speed change of the intermediate transfer belt 12 occurring with a period of one rotation of the roller member causing the speed change can be aligned between at the direct transfer nip and at the sensing position. Therefore, it is possible to cancel out the influences of the periodic speed change occurring with a period of one rotation of the roller member causing the speed change to the rotation speed of the intermediate transfer belt 12 at the direct transfer nip and at the sensing position. Accordingly, it is possible to prevent the pattern image which is reversely transferred at the direct transfer nip from a photosensitive element 11K which is a second image carrier to the intermediate transfer belt 12 from being erroneously sensed, due to the periodic speed change of the intermediate transfer belt 12 occurring with a period of one rotation of the roller member causing the speed change, so that the pattern image is expanded or contracted at the sensing position than when directly transferred. Therefore, since the periodic speed change of the intermediate transfer belt 12 occurring with a period of one rotation of the roller member can be neglected and thus only the other changes are detected from the pattern images by the optical sensor 29, the color matching adjustment can be performed based on the sensing result, so that the accuracy of the color matching adjustment can be improved.

In addition, according to the third embodiment, in the case where a radius of a driving roller 8 which drives to rotate the intermediate transfer belt 12 and is one of the roller members by which the intermediate transfer belt 12 is suspended is denoted by r3 and the distance between the primary transfer nip and the sensing position in the intermediate transfer belt rotation direction is denoted by d3, a relationship of $d3=2\pi r3 \cdot n5$ (n5 is a natural number) is satisfied, so that the phases of the periodic speed change of the intermediate transfer belt 12 occurring with a period of one rotation of the driving roller 8 can be aligned between at the primary transfer nip and at the sensing position. Therefore, it is possible to cancel out the influences of the periodic speed change occurring with a period of one rotation of the driving roller 8 to the rotation speed of the intermediate transfer belt 12 at the primary transfer nip and at the sensing position. Accordingly, it is possible to prevent the Y, M, and C pattern images which are primarily transferred at the primary transfer nips from the first image carriers to the intermediate transfer belt 12 from being erroneously sensed, due to the periodic speed change of the intermediate transfer belt 12 occurring with a period of one rotation of the driving roller 8, so that the pattern images are expanded or contracted at the sensing position than when primarily transferred.

In addition, according to the third embodiment, in the case where a radius of a driving roller 8 which drives to rotate the intermediate transfer belt 12 and is one of the roller members by which the intermediate transfer belt 12 is suspended is denoted by r3 and the distance between the secondary transfer nip and the sensing position in the intermediate transfer belt rotation direction is denoted by d4, a relationship of $d4=2\pi r3 \cdot n6$ (n6 is a natural number) is satisfied, so that the phases of the periodic speed change of the intermediate transfer belt 12 occurring with a period of one rotation of the driving roller 8 can be aligned between at the direct transfer nip and at the sensing position. Therefore, it is possible to cancel out the influences of the periodic speed change occurring with a period of one rotation of the driving roller 8 to the rotation speed of the intermediate transfer belt 12 at the direct transfer nip and at the sensing position. Accordingly, it is possible to prevent the K pattern image which is reversely transferred at the direct transfer nip from the photosensitive element 11K to the intermediate transfer belt 12 from being erroneously sensed, due to the periodic speed change of the intermediate transfer belt 12 occurring with a period of one rotation of the driving roller 8, so that the pattern image is expanded or contracted at the sensing position than when primarily transferred.

In addition, according to the third embodiment, in the case where a radius of a driven roller which are driven to rotate by the rotation of the intermediate transfer belt 12 among the plurality of roller members by which the intermediate transfer belt 12 is suspended is denoted by r4, the distance between the primary transfer nip and the sensing position in the intermediate transfer belt rotation direction is denoted by d3, and the distance between the secondary transfer nip and the sensing position in the intermediate transfer belt rotation direction is denoted by d4, a relationship of $d3=2\pi r4 \cdot n7$ (n7 is a natural number) and a relationship of $d4=2\pi r4 \cdot n8$ (n8 is a natural number) are satisfied, so that it is possible to suppress a deterioration in the accuracy of the color matching adjustment occurring with each driven roller pitch.

In addition, according to the fourth embodiment, the image forming apparatus includes: the driving roller 8 which drives to rotate the intermediate transfer belt 12 and is one of the roller members by which the intermediate transfer belt 12 is suspended; the driven roller 18 which is a driven roller which is driven to rotate by the rotation of the intermediate transfer belt 12 and is one of the roller members by which the intermediate transfer belt 12 is suspended; an intermediate transfer belt speed detecting unit which is disposed at the driven roller 18 to detect a rotation speed of the intermediate transfer belt; and a feedback control unit which controls the rotation driving of the driving roller 8 in a feedback manner by using a detection result detected by the intermediate transfer belt speed detecting unit, and wherein in the case where a radius of the driven roller 18 is denoted by R2, the distance between the primary transfer nip and the sensing position in the intermediate transfer belt rotation direction is denoted by d3, and the distance between the secondary transfer nip and the sensing position in the intermediate transfer belt rotation direction is denoted by d4, a relationship of $d3=2\pi R2 \cdot N3$ (N3 is a natural number) and a relationship of $d4=2\pi R2 \cdot N4$ (N4 is a natural number) are satisfied. Since the distance d3 is configured to be a natural times the circumferential length of the driven roller 18, the phases of the periodic speed change of the intermediate transfer belt 12 occurring with a period of one rotation of the driven roller 18 can be aligned between at the primary transfer nip and at the sensing position. Therefore, it is possible to cancel out the influences of the periodic speed change occurring with a period of one rotation of the driven roller 18 to the rotation speed of the intermediate transfer belt 12 at the primary transfer nip and at the sensing position. Accordingly, it is possible to prevent the Y, M, and C pattern images which are primarily transferred at the primary transfer nips from the first image carriers to the intermediate transfer belt 12 from being erroneously sensed, due to the periodic speed change of the intermediate transfer belt 12 occurring with a period of one rotation of the driven roller 18, so that the pattern images are expanded or contracted at the sensing position than when primarily transferred. In addition, since the distance d4 is configured to be a natural number times the circumferential length of the driven roller 18, the phases of the periodic speed change of the intermediate transfer belt 12 occurring with a period of one rotation of the driven roller 18 can be aligned between at the secondary transfer nip and at the sensing position. Therefore, it is possible to cancel out the influences of the periodic speed change occurring with a period of one rotation of the driven roller 18 to the rotation speed of the intermediate transfer belt 12 at the secondary transfer nip and at the sensing position. Accordingly, it is possible to prevent the K pattern image which is reversely transferred at the secondary transfer nip from the direct transfer belt 13 to the intermediate transfer belt 12 from being erroneously sensed, due to the periodic speed change of the intermediate transfer belt 12 occurring with a period of one rotation of the driven roller 18, so that the pattern image is expanded or contracted at the sensing position than when directly transferred.

In addition, according to the fourth embodiment, the intermediate transfer belt speed detecting unit may include a rotary encoder which is disposed coaxially with the driven roller 18 which is the driven roller to measure a rotation angle speed or a rotation angle change of the driven roller 18.

In addition, according to the third and fourth embodiments, by employing a configuration in which a plurality of the optical sensors 29 are provided in a direction perpendicular to the intermediate transfer belt rotation direction, a difference between left and right sides in the image sub-scan direction is sensed to perform the color matching adjustment.

In addition, according to the third and fourth embodiments, by employing a configuration in which the adjustment image is formed with a horizontal pattern image perpendicular to the intermediate transfer belt rotation direction and a slant pattern image intersecting the intermediate transfer belt rotation direction at 45 degrees so as to perform color matching adjustment between the images formed by a plurality of the image carriers, the color matching adjustment can be performed by sensing the color irregularity of the image in the main scan direction and the sub-scan direction by the optical sensor 29.

As described above, according to the first and second embodiments, it is possible to obtain an excellent effect in that it is possible to prevent the pattern image from being erroneously sensed due to the speed change of the recording medium transport belt.

According to the third and fourth embodiments, it is possible to obtain an excellent effect in that it is possible to prevent the pattern image from being erroneously sensed due to the speed change of the intermediate transfer belt.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first image carrier;

a first image forming unit which forms an image on the first image carrier;

an intermediate transfer body to which the image formed on the first image carrier is primarily transferred;

a primary transfer unit which primarily transfers the image from the first image carrier to the intermediate transfer body;

a secondary transfer unit which secondarily transfers the image transferred to the intermediate transfer body to a recording medium;

a second image carrier which is disposed at upstream or downstream in a transport direction of the recording medium from a secondary transfer position where the image is secondarily transferred from the intermediate transfer body to the recording medium;

a second image forming unit which forms an image on the second image carrier;

a direct transfer unit which directly transfers the image formed on the second image carrier to the recording medium;

a recording medium transport belt which is rotatably suspended by a plurality of roller members to transport the recording medium mounted thereon so as to pass a direct transfer position where the image is directly transferred from the second image carrier to the recording medium and the secondary transfer position; and a pattern image sensing unit which is disposed to face a front surface of the recording medium transport belt and which senses a pattern image transferred to the recording medium transport belt after being formed on the first image carrier and the second image carrier, wherein a distance between the secondary transfer position and the sensing position of the pattern image by the pattern image sensing unit in a rotation direction of the recording medium transport belt and a distance between the direct transfer position and the sensing position in the rotation direction of the recording medium transport belt are a natural number times a circumferential length of a roller member causing a speed change in the recording medium transport belt among the plurality of roller members by which the recording medium transport belt is suspended, and wherein when a radius of a driven roller which is driven to rotate by the rotation of the recording medium transport belt among the plurality of roller members by which the recording medium transport belt is suspended is denoted by $r2$, the distance between the secondary transfer position and the sensing position in the rotation direction of the recording medium transport belt is denoted by $d1$, and the distance between the direct transfer position and the sensing position in the rotation direction of the recording medium transport belt is denoted by $d2$, a relationship of $d1=2\pi r2 \cdot n3$ ($n3$ is a natural number) and a relationship of $d2=2\pi r2 \cdot n4$ ($n4$ is a natural number) are satisfied.

2. The image forming apparatus according to claim 1, wherein when a radius of a driving roller which drives to rotate the recording medium transport belt and is one of the roller members by which the recording medium transport belt is suspended is denoted by $r1$ and the distance between the secondary transfer position and the sensing position in the rotation direction of the recording medium transport belt is denoted by $d1$, a relationship of $d1=2\pi r1 \cdot n1$ ($n1$ is a natural number) is satisfied.

3. The image forming apparatus according to claim 1, wherein when a radius of a driving roller which drives to rotate the recording medium transport belt and is one of the roller members by which the recording medium transport belt is suspended is denoted by $r1$ and the distance between the direct transfer position and the sensing position in the rotation direction of the recording medium transport belt is denoted by $d2$, a relationship of $d2=2\pi r1 \cdot n2$ ($n2$ is a natural number) is satisfied.

4. An image forming apparatus comprising:

a first image carrier;

a first image forming unit which forms an image on the first image carrier;

an intermediate transfer body to which the image formed on the first image carrier is primarily transferred;

a primary transfer unit which primarily transfers the image from the first image carrier to the intermediate transfer body;

a secondary transfer unit which secondarily transfers the image transferred to the intermediate transfer body to a recording medium;

a second image carrier which is disposed at upstream or downstream in a transport direction of the recording medium from a secondary transfer position where the image is secondarily transferred from the intermediate transfer body to the recording medium;

a second image forming unit which forms an image on the second image carrier;

a direct transfer unit which directly transfers the image formed on the second image carrier to the recording medium;

a recording medium transport belt which is rotatably suspended by a plurality of roller members to transport the recording medium mounted thereon so as to pass a direct transfer position where the image is directly transferred from the second image carrier to the recording medium and the secondary transfer position; and a pattern image sensing unit which is disposed to face a front surface of the recording medium transport belt and which senses a pattern image transferred to the recording medium transport belt after being formed on the first image carrier and the second image carrier, wherein a distance between the secondary transfer position and the sensing position of the pattern image by the pattern image sensing unit in a rotation direction of the recording medium transport belt and a distance between the direct transfer position and the sensing position in the rotation direction of the recording medium transport belt are a natural number times a circumferential length of a roller member causing a speed change in the recording medium transport belt among the plurality of roller members by which the recording medium transport belt is suspended, the image forming apparatus further comprising:

a driving roller which drives to rotate the recording medium transport belt and is one of the roller members by which the recording medium transport belt is suspended;

a driven roller which is driven to rotate by the rotation of the recording medium transport belt and is one of the roller members by which the recording medium transport belt is suspended;

a recording medium transport belt speed detecting unit which is provided at the driven roller to detect a rotation speed of the recording medium transport belt; and a feedback control unit which controls rotation driving of the driving roller in a feedback manner by using a detection result detected by the recording medium transport belt speed detecting unit, wherein when a radius of the driven roller is denoted by R1, the distance between the secondary transfer position and the sensing position in the rotation direction of the recording medium transport belt is denoted by d1, and the distance between the direct transfer position and the sensing position in the rotation direction of the recording medium transport belt is denoted by d2, a relationship of $d1=2\pi R1 \cdot N1$ (N1 is a natural number) and a relationship of $d2=2\pi R1 \cdot N2$ (N2 is a natural number) are satisfied.

5. The image forming apparatus according to claim 4, wherein the recording medium transport belt speed detecting unit includes a rotary encoder which is disposed coaxially with the driven roller to measure a rotation angle speed or a rotation angle change of the driven roller.

6. The image forming apparatus according to claim 1, wherein a plurality of the pattern image sensing units is provided in a direction perpendicular to the rotation direction of the recording medium transport belt.

7. The image forming apparatus according to claim 1, wherein the pattern image is formed with a horizontal pattern perpendicular to the rotation direction of the recording medium transport belt and a slant pattern intersecting the rotation direction of the recording medium transport belt at 45 degrees so as to perform color matching adjustment between the images formed by the first image carrier and the second image carrier.

8. An image forming apparatus comprising:

a first image carrier;

a first image forming unit which forms an image on the first image carrier;

an intermediate transfer belt to which the image formed on the first image carrier is primarily transferred and which is rotatably suspended by a plurality of roller members;

a primary transfer unit which primarily transfers the image at a primary transfer position from the first image carrier to the intermediate transfer belt;

a secondary transfer unit which secondarily transfers the image transferred to the intermediate transfer belt to a recording medium;

a second image carrier which is disposed at upstream or downstream in a transport direction of the recording medium from a secondary transfer position where the image is secondarily transferred from the intermediate transfer belt to the recording medium;

a second image forming unit which forms an image on the second image carrier;

a direct transfer unit which directly transfers the image formed on the second image carrier to the recording medium;

a recording medium transport belt which is rotatably suspended by a plurality of roller members to transport the recording medium mounted thereon so as to pass a direct transfer position where the image is directly transferred from the second image carrier to the recording medium and the secondary transfer position; and a pattern image sensing unit which is disposed to face a front surface of the intermediate transfer belt and which senses a pattern image transferred to the intermediate transfer belt after being formed on the first image carrier and the second image carrier, wherein a distance between the primary transfer position and the sensing position of the pattern image by the pattern image sensing unit in a rotation direction of the intermediate transfer belt and a distance between the secondary transfer position and the sensing position in the rotation direction of the intermediate transfer belt are a natural number times a circumferential length of a roller member causing a speed change in the intermediate transfer belt among the plurality of roller members by which the intermediate transfer belt is suspended, and wherein when a radius of a driven roller which is driven to rotate by the rotation of the intermediate transfer belt among the plurality of roller members by which the intermediate transfer belt is suspended is denoted by r4, the distance between the primary transfer position and the sensing position in the rotation direction of the intermediate transfer belt is denoted by d3, and the distance between the secondary transfer position and the sensing position in the rotation direction of the intermediate transfer belt is denoted by d4, a relationship of $d3=2\pi r4 \cdot n8$ (n8 is a natural number) and a relationship of $d4=2\pi r4 \cdot n9$ (n9 is a natural number) are satisfied.

9. The image forming apparatus according to claim 8, wherein when a radius of a driving roller which drives to rotate the intermediate transfer belt and is one of the roller members by which the intermediate transfer belt is suspended is denoted by r3 and the distance between the primary transfer position and the sensing position in the rotation direction of the intermediate transfer belt is denoted by d3, a relationship of $d3=2\pi r3 \cdot n5$ (n5 is a natural number) is satisfied.

10. The image forming apparatus according to claim 8, wherein when a radius of a driving roller which drives to rotate the intermediate transfer belt and is one of the roller members by which the intermediate transfer belt is suspended is denoted by r3 and the distance between the secondary transfer position and the sensing position in the rotation direction of the intermediate transfer belt is denoted by d4, a relationship of $d4=2\pi r3 \cdot n6$ (n6 is a natural number) is satisfied.

11. An image forming apparatus, comprising:

a first image carrier;

a first image forming unit which forms an image on the first image carrier;

an intermediate transfer belt to which the image formed on the first image carrier is primarily transferred and which is rotatably suspended by a plurality of roller members;

a primary transfer unit which primarily transfers the image at a primary transfer position from the first image carrier to the intermediate transfer belt;

a secondary transfer unit which secondarily transfers the image transferred to the intermediate transfer belt to a recording medium;

a second image carrier which is disposed at upstream or downstream in a transport direction of the recording medium from a secondary transfer position where the image is secondarily transferred from the intermediate transfer belt to the recording medium;

a second image forming unit which forms an image on the second image carrier;

a direct transfer unit which directly transfers the image formed on the second image carrier to the recording medium;

a recording medium transport belt which is rotatably suspended by a plurality of roller members to transport the recording medium mounted thereon so as to pass a direct transfer position where the image is directly transferred from the second image carrier to the recording medium and the secondary transfer position; and a pattern image sensing unit which is disposed to face a front surface of the intermediate transfer belt and which senses a pattern image transferred to the intermediate transfer belt after being formed on the first image carrier and the second image carrier, and wherein a distance between the primary transfer position and the sensing position of the pattern image by the pattern image sensing unit in a rotation direction of the intermediate transfer belt and a distance between the secondary transfer position and the sensing position in the rotation direction of the intermediate transfer belt are a natural number times a circumferential length of a roller member causing a speed change in the intermediate transfer belt among the plurality of roller members by which the intermediate transfer belt is suspended, the image forming apparatus further comprising:

a driving roller which drives to rotate the intermediate transfer belt and is one of the roller members by which the intermediate transfer belt is suspended;

a driven roller which is driven to rotate by the rotation of the intermediate transfer belt and is one of the roller members by which the intermediate transfer belt is suspended;

an intermediate transfer belt speed detecting unit which is provided at the driven roller to detect a rotation speed of the intermediate transfer belt; and a feedback control unit which controls rotation driving of the driving roller in a feedback manner by using a detection result detected by the intermediate transfer belt speed detecting unit, wherein when a radius of the driven roller is denoted by R2, the distance between the primary transfer position and the sensing position in the rotation direction of the intermediate transfer belt is denoted by d3, and the distance between the secondary transfer position and the sensing position in the rotation direction of the intermediate transfer belt is denoted by d4, a relationship of $d3=2\pi R2 \cdot N3$ (N3 is a natural number) and a relationship of $d4=2\pi R2 \cdot N4$ (N4 is a natural number) are satisfied.

12. The image forming apparatus according to claim 11, wherein the intermediate transfer belt speed detecting unit includes a rotary encoder which is disposed coaxially with the driven roller to measure a rotation angle speed or a rotation angle change of the driven roller.

13. The image forming apparatus according to claim 8, wherein a plurality of the pattern image sensing units is provided in a direction perpendicular to the intermediate transfer belt rotation direction.

14. The image forming apparatus according to claim 8, wherein the pattern image is formed with a horizontal pattern perpendicular to the rotation direction of the intermediate transfer belt and a slant pattern intersecting the rotation direction of the intermediate transfer belt at 45 degrees so as to perform color matching adjustment between the images formed by the first image carrier and the second image carrier.

* * * * *